US009254678B2

(12) United States Patent
Watanabe et al.

(10) Patent No.: US 9,254,678 B2
(45) Date of Patent: Feb. 9, 2016

(54) OPTICAL PRINT HEAD HAVING FIRST AND SECOND POWER LINES AND IMAGE FORMING APPARATUS

(71) Applicant: Konica Minolta, Inc., Chiyoda-ku, Tokyo (JP)

(72) Inventors: Yoshikazu Watanabe, Toyohashi (JP); Satoshi Masuda, Neyagawa (JP); Makoto Obayashi, Toyokawa (JP); Masayuki Iijima, Okazaki (JP); So Yano, Ibaraki (JP); Takaki Uemura, Seto (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/664,086

(22) Filed: Mar. 20, 2015

(65) Prior Publication Data

US 2015/0266310 A1 Sep. 24, 2015

(30) Foreign Application Priority Data

Mar. 20, 2014 (JP) ..... 2014-058285

(51) Int. Cl.
*B41J 2/435* (2006.01)
*B41J 2/47* (2006.01)

(52) U.S. Cl.
CPC ..... *B41J 2/47* (2013.01)

(58) Field of Classification Search
CPC ..... B41J 2/47
USPC ..... 347/247; 345/76; 434/433
See application file for complete search history.

(56) References Cited

U.S. PATENT DOCUMENTS

2005/0146593 A1 7/2005 Yamazaki et al.
2005/0243039 A1* 11/2005 Kwak ..... 345/76
2007/0128583 A1* 6/2007 Miyazawa ..... 434/433
2010/0277455 A1 11/2010 Miwa et al.

FOREIGN PATENT DOCUMENTS

JP 2005144686 A 6/2005
JP 2007076082 A 3/2007
JP 2009098539 A 5/2009

* cited by examiner

*Primary Examiner* — Julian Huffman
*Assistant Examiner* — Carlos A Martinez
(74) *Attorney, Agent, or Firm* — Cantor Colburn LLP

(57) ABSTRACT

Optical print head includes: light-emitting elements connected one-to-one to current supply lines branching from first power line at different positions in longitudinal direction; holding elements; signal writing unit writing luminance signal into each holding element, the luminance signal being represented by voltage indicating light emission amount of corresponding light-emitting element; second power line supplying reference voltage to each holding element, the reference voltage being reference when signal writing unit writes luminance signal into holding element; and driving drivers corresponding one-to-one with current supply lines and controlling current supplied to corresponding current supply line from first power line, in accordance with voltage held in corresponding holding element when signal writing unit has written luminance signal into corresponding holding element, wherein power source supplying the reference voltage to second power line is common with power source supplying voltage to signal output subunit outputting luminance signal.

13 Claims, 12 Drawing Sheets

<Comparative example>

OPTICAL PRINT HEAD HAVING FIRST AND SECOND POWER LINES AND IMAGE FORMING APPARATUS

CROSS REFERENCE TO RELATED APPLICATIONS

The present invention claims priority under 35 U.S.C. §119 to Japanese Application No. 2014-058285, filed Mar. 20, 2014, the entire content of which is incorporated herein by reference.

BACKGROUND OF THE INVENTION (1) Field of the Invention

The present invention relates to an optical print head (PH) that performs writing onto a photoreceptor by an optical beam and an image forming apparatus including the optical PH.

(2) Related Art

Some of image forming apparatuses such as printers include an optical PH that writes an image onto a photoreceptor by an optical beam emitted from each of minute light-emitting elements that are arranged in line.

Japanese Patent Application Publication No. 2005-144686 discloses, as an optical PH, a line head including a large number of organic EL elements as light-emitting elements that are arranged on a substrate in a main scanning direction.

Such a line head has a configuration in which a parallel circuit is arranged on the substrate, which is composed of the organic EL elements each having an anode connected with a power line A on a power source side and a cathode connected with a power line B on a ground side. Also, a moisture-proof plate is provided spaced from the substrate, and has wired thereon an auxiliary power line C on the power source side and an auxiliary power line D on the ground side.

The line head has a circuit configuration in which an increased number of power feeding points for the organic EL elements are provided by electrically connecting the power line A on the substrate with the auxiliary power line C on the moisture-proof plate at a plurality of points and electrically connecting the power line B on the substrate with the auxiliary power line D on the moisture-proof plate at a plurality of points.

With this circuit configuration in which an increased number of power feeding points are provided, it is possible to shorten a wiring distance on the power line from one power feeding point to each of the organic EL elements compared with the configuration in which a less number of power feeding points are provided. Since there is a less potential drop due to a wiring resistance, it is possible to decrease a difference in supply current between the organic EL elements caused by the potential drop, thereby suppressing unevenness in light emission amount between the organic EL elements.

However, even if the configuration is adopted in which a certain increased number of power feeding points are provided as in the configuration disclosed in the above patent application publication, there is no change that a potential drop occurs on a part of a power line between each two adjacent power feeding points in the current flowing direction. Accordingly, a problem still remains that unevenness in light emission amount due to the potential drop is not eliminated.

SUMMARY OF THE INVENTION

The present invention aims to provide an optical PH that is capable of suppressing unevenness in light emission amount between light-emitting elements due to a potential drop on a power line caused by a current flowing through each of the light-emitting elements from the power line, and an image forming apparatus that includes the optical PH.

The above aim is achieved by an optical print head including: a plurality of light-emitting elements that are connected to a plurality of current supply lines in one-to-one correspondence, the current supply lines branching from a first power line at different branch positions in a longitudinal direction thereof; a plurality of holding elements that are provided in one-to-one correspondence with the light-emitting elements; a signal writing unit that writes a luminance signal into each of the holding elements, the luminance signal being represented by a voltage indicating a light emission amount of a corresponding one of the light-emitting elements; a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line is common with a power source that supplies a voltage to the signal output subunit.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 8 illustrates graphs each representing a relation between a wiring distance from a power supply point to each of the OLEDs in a sample period or a hold period and a potential drop under the situation where all the OLEDs are turned on, and so on;

FIG. 13 is a timing chart in the case where a control is performed for interrupting a current supply path to an OLED included in the m-th light-emitting unit only in sample periods under the situation where all the OLEDs are turned on.

DESCRIPTION OF PREFERRED EMBODIMENTS

The following describes embodiments of an optical PH and an image forming apparatus relating to the present invention with use of an example of a tandem-type color printer (hereinafter, referred to simply as a printer).

Embodiment 1

Figure 1:
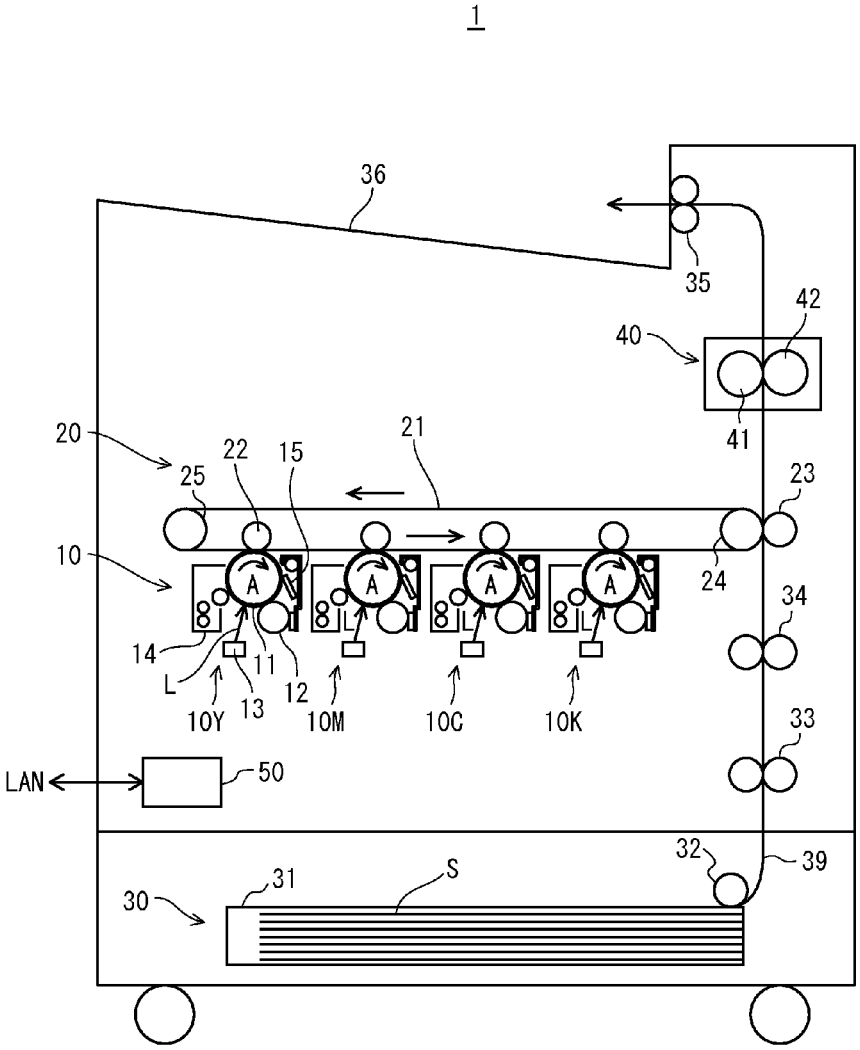
FIG. 1 shows a configuration of an image forming apparatus relating to Embodiment 1.

FIG. 1 shows the overall configuration of a printer 1 relating to the present embodiment.

As shown in the figure, the printer 1 forms images by an electronic photography system, and includes an image process unit 10, an intermediate transfer unit 20, a paper feed unit 30, a fixing unit 40, and a control unit 50. The printer 1 executes color image formation (print) in response to a job execution request from an external terminal device (not shown) via a network such as an LAN.

The image process unit 10 includes image forming subunits 10Y, 10M, 10C, and 10K corresponding to respective developing colors of yellow (Y), magenta (M), cyan (C), and black (K).

The image forming subunit 10Y includes a photosensitive drum 11 as an image carrier, and a charging unit 12, an exposure unit 13, a developing unit 14, a cleaner 15, and so on that are provided surrounding the photosensitive drum 11.

The charging unit 12 charges a circumferential surface of the photosensitive drum 11 that rotates in a direction indicated by an arrow A.

The exposure unit (optical PH) 13 exposes the charged photosensitive drum 11 by an optical beam L to form an electrostatic latent image on the photosensitive drum 11. Since the present embodiment adopts a so-called reversal development system, exposure is performed on a part where a toner image is to be formed in a charged region of the circumferential surface of the photosensitive drum 11. As a result, an electrostatic latent image is formed.

Also, the exposure unit 13 includes a print head that is composed of a large number of current-driven organic EL elements (hereinafter, referred to as OLEDs) as light-emitting elements that are arranged on a substrate in an axial direction of the photosensitive drum 11 (hereinafter, referred to as a main direction). A configuration of this print head is described later.

The developing unit 14 develops the electrostatic latent image, which is formed on the photosensitive drum 11, by toner of the Y color. As a result, a toner image of the Y color is formed on the photosensitive drum 11, and the toner image of the Y color is primarily transferred onto an intermediate transfer belt 21 included in the intermediate transfer unit 20. The cleaner 15 cleans residual toner on the photosensitive drum 11 after the primary transfer. Other image forming subunits 10M, 10C, and 10K have the same configuration as the image forming subunit 10Y, and therefore reference numerals thereof are omitted in the figure.

The intermediate transfer unit 20 includes the intermediate transfer belt 21, a primary transfer roller 22, and a secondary transfer roller 23. The intermediate transfer belt 21 is suspended with tension between a driving roller 24 and a driven roller 25 to circularly run in a direction indicated by an arrow. The primary transfer roller 22 is disposed to face the respective photosensitive drums 11 of the image forming subunits 10Y, 10M, 10C, and 10K with the intermediate transfer belt 21 therebetween. The secondary transfer roller 23 is disposed to face the driving roller 24 via the intermediate transfer belt 21.

The paper feed unit 30 includes a cassette 31, a pickup roller 32, and conveyance rollers 33 and 34. The cassette 31 houses therein sheets, specifically, sheets S here. The pickup roller 32 picks up the sheets S from the cassette 31 to a convey path piece by piece. The conveyance rollers 33 and 34 convey the sheets S which are picked up.

The fixing unit 40 includes a fixing roller 41 and a pressure roller 42 that is brought into pressure-contact with the fixing roller 41.

The control unit 50 collectively controls operations of the image process unit 10, the intermediate transfer unit 20, the paper feed unit 30, and the fixing unit 40 to smoothly execute a job. The control unit 50 performs the following operations for job execution.

Specifically, based on image data for print included in the received job, driving data is generated for light emission from the OLEDs which are disposed in the respective exposure units 12 included in the image forming subunits 10Y, 10M, 10C, and 10K.

This driving data is a digital signal here, and accordingly is converted by a luminance signal output subunit 51 (FIG. 3) included in the control unit 50 to an analog light amount set signal (hereinafter, referred to as a luminance signal) indicating a light emission amount of each of the OLEDs. The luminance signal is transmitted to the exposure unit 13. The OLEDs included in the exposure unit 13 each emit an optical beam L of a light amount based on the analog luminance signal.

The optical beam L is emitted from each of the OLEDs included in the exposure unit 13 for each of the image forming subunit 10Y, 10M, 10C, and 10K, and the photosensitive drum 11 which is charged is exposed by the optical beam L, and an electrostatic latent image is formed on the photosensitive drum 11. The electrostatic latent image, which is formed on the photosensitive drum 11, is developed by toner, and as a result a toner image is formed.

The toner images, which are formed on the respective photosensitive drums 11 of the Y, M, C, and K colors, are primarily transferred onto an intermediate transfer belt 21 by the action of an electrostatic force imposed by the primary transfer roller 22 which is disposed on the photosensitive drum 11 via the intermediate transfer belt 21.

An image forming operation for each of the Y, M, C, and K colors is started in accordance with a different timing from the upstream side to the downstream side such that the respective toner images of the Y, M, C, and K colors are multi-transferred in layered form on the same position on the intermediate transfer belt 21 which is running.

In accordance with this timing for image formation, sheets S are conveyed by the paper feed unit 30 from the cassette 31 to the secondary transfer roller 23. When a sheet S passes through between the secondary transfer roller 23 and the intermediate transfer belt 21, the respective toner images of the Y, M, C, and K colors, which are multi-transferred onto the intermediate transfer belt 21, are transferred all at once onto the sheet S by the action of an electrostatic force imposed by the secondary transfer roller 23.

The sheets S, onto which the respective toner images of the Y, M, C, and K colors are secondarily transferred, is conveyed to the fixing unit 40. When the sheet S passes through between the fixing roller 41 and the pressure roller 42 included in the fixing unit 40, the sheet S is heated and pressed. As a result, toner on the sheet S is fused and fixed to the sheet S. After passing through the fixing unit 40, the sheet S is ejected (output) by a paper ejection roller 35 onto a paper ejection tray 36.

Figure 2:
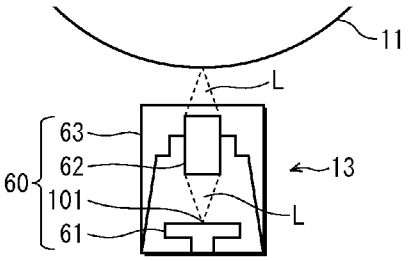
FIG. 2 schematically shows a configuration of a print head included in an exposure unit of the image forming apparatus.

FIG. 2 schematically shows a configuration of a print head 60 included in the exposure unit 13.

As shown in the figure, the print head 60 includes an OLED panel 61, a rod lens array 62, and a housing 63 that houses therein the OLED panel 61 and the rod lens array 62.

The OLED panel 61 includes a plurality of OLEDs 101 that are arranged in line and each emit an optical beam L separately.

The rod lens array 62 causes the optical beam L, which is emitted from each of the OLEDs 101, to form an image on a surface of the photosensitive drum 11.

Figure 3:
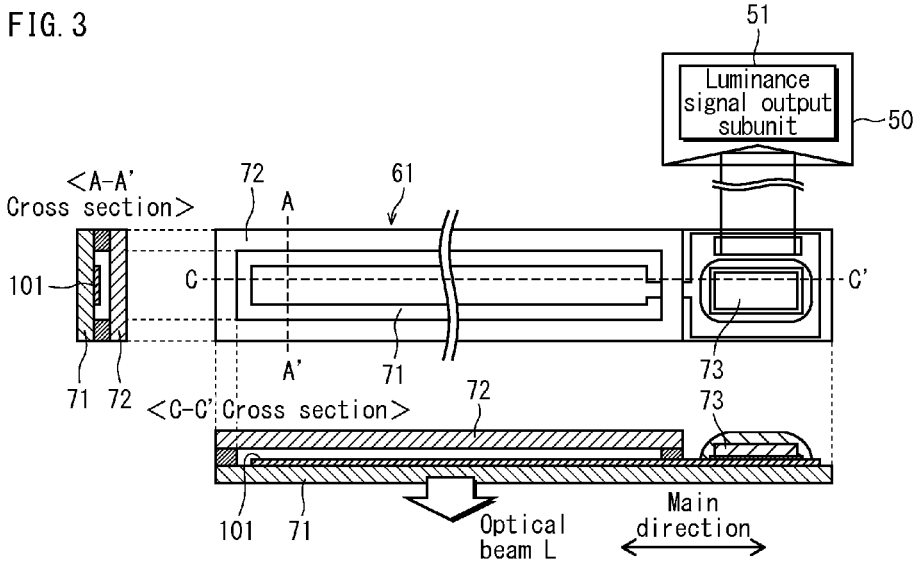
FIG. 3 is a schematic plan view and cross-sectional views showing an OLED panel of the print head.

FIG. 3 is a schematic plan view showing the OLED panel 61, including a cross-sectional view taken along line A-A' and a cross-sectional view taken along line C-C'.

As shown in the figure, the OLED panel 61 includes a thin film transistor (TFT) substrate 71, a sealing plate 72, and a source IC 73.

The TFT substrate 71 has the OLEDs 101 arranged thereon in the main direction. The TFT substrate 71 also has provided thereon, for each of the OLEDs 101, a drive circuit, a holding element, a power selector switch, and so on, which are described later. The OLED panel 61 has the circuit structure in which these components are formed on the same TFT substrate 71.

The sealing plate 72 is provided for sealing a region were the OLEDs 101 are arranged on the TFT substrate 71 so as not to be exposed to ambient air.

The source IC 73 is mounted on a region on the TFT substrate 71 other than a region where the sealing plate 72 is provided, and includes a plurality of digital/analog converters (hereinafter, referred to as DACs) and a shift register which is described later. The DACs each convert a digital luminance signal, which is output from the luminance signal output subunit 51 included in the control unit 50, to a luminance signal represented by an analog voltage indicating a light emission amount of a corresponding one of the OLEDs 101.

Figure 4:
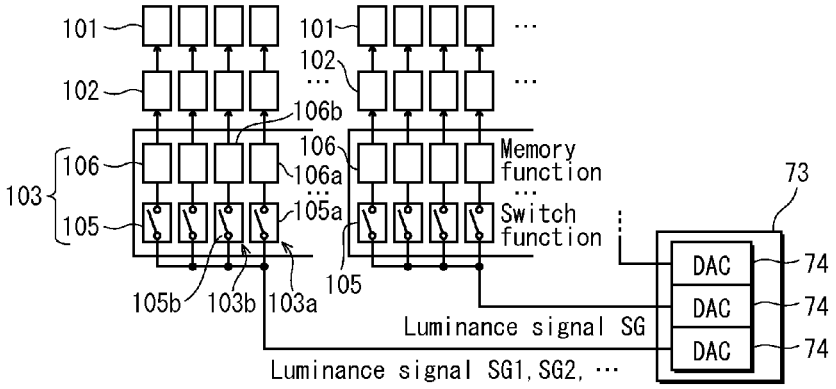
FIG. 4 schematically shows a relation between OLEDs, drive circuits, S/H circuits, and so on that are provided on a TFT substrate of the OLED panel.

FIG. 4 schematically shows a relation between the OLEDs 101, drive circuits 102, sample/hold (S/H) circuits 103, and the source IC 73, which are provided on the TFT substrate 71.

As shown in the figure, the S/H circuits 103 are each composed of a switch 105 and a holding element (such as a capacitor) 106 that are series-connected with each other. The S/H circuits 103 one-to-one correspond to the drive circuits 102, and the drive circuits 102 one-to-one correspond to the OLEDs 101.

On the other hand, the source IC 73 includes a plurality of DACs 74 that each correspond to every plural S/H circuits 103. The DACs 74 each successively output a luminance signal SG for each of the OLEDs 101 to a corresponding one of the corresponding S/H circuits 103.

Assume a case for example in which while the respective switches 105 of the S/H circuits 103 corresponding to one DAC 74 are off (non-conductive), the DAC 74 outputs luminance signals SG1, SG2, . . . , which are generated based on image data, one by one in order of time.

In such a case, in synchronization with a timing when the luminance signal SG1 is output from the DAC 74, only a switch 105*a* of an S/H circuit 103*a* among the S/H circuits 103, into which the luminance signal SG1 is to be written, is switched from off to on (conductive), and the luminance signal SG1 is written into a holding element 106*a* of the S/H circuit 103*a* (sampling of the luminance signal).

Note that since the respective switches 105 of the S/H circuits 103 other than the S/H circuit 103*a* remain off, the luminance signal SG1 cannot be written into the respective holding elements 106 of the S/H circuits 103 other than the S/H circuit 103*a*.

When writing of the luminance signal SG1 into the holding element 106*a* of the S/H circuit 103*a* completes, the switch 105*a* of the S/H circuit 103*a* is returned to off, but a charge corresponding to a voltage representing the luminance signal SG1 is still held in the holding element 106*a*.

Then, in synchronization with a timing when the subsequent luminance signal SG2 is output from the DAC 74, only a switch 105*b* of an S/H circuit 103*b*, into which the luminance signal SG2 is to be written, is switched from off to on, and the luminance signal SG2 is written into a holding element 106*b* of the S/H circuit 103*b*.

When writing of the luminance signal SG2 into the holding element 106*b* of the S/H circuit 103*b* completes, the switch 105*b* of the S/H circuit 103*b* is returned to off, but a charge corresponding to a voltage representing the luminance signal SG2 is still held in the holding element 106*b*.

Figure 5:
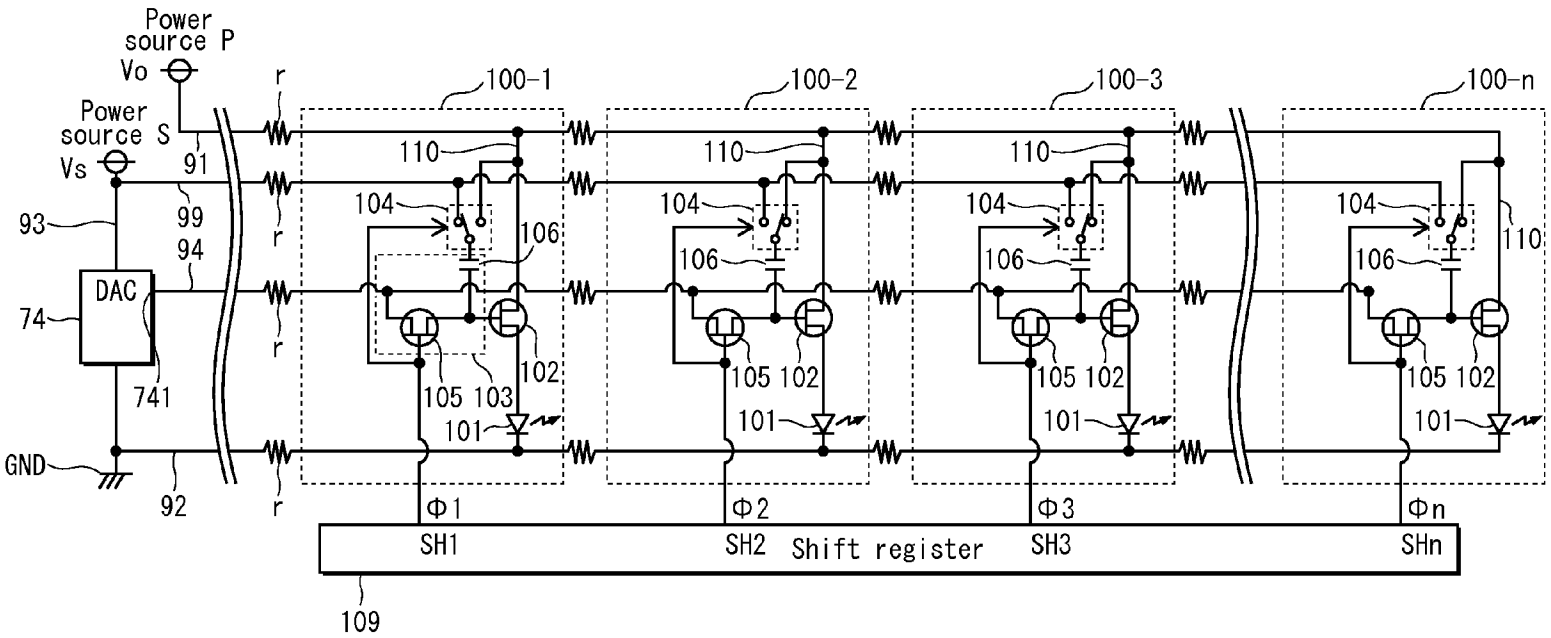
FIG. 5 shows a circuit configuration in which n (a plurality of) light-emitting units are provided, each of which includes the OLEDs.

A writing operation of the luminance signal SG is performed for each of the S/H circuits 103 in order of time by switching a corresponding one of the switches 105 in accordance with an input timing of the luminance signal SG. This switching is performed with use of a shift register 109 (FIG. 5).

The drive circuits 102 each control a current from a power source (not shown) in accordance with a voltage generated from the charge which is held in a corresponding one of the holding elements 106, and output the controlled current for supply to a corresponding one of the OLEDs 101. The supply of the current causes the OLED 101 to emit light of an amount based on the luminance signal SG.

Note that the image data includes data of a non-exposure region in which toner images are not formed (such as a background part in a document), and a luminance signal SG corresponding to the non-exposure region is a signal indicating a light emission amount of zero such as a signal represented by a voltage of 0 V. When a luminance signal indicates a light emission amount of zero, no current is supplied from the drive circuit 102 to the OLED 101, and accordingly the OLED 101 remains turned off.

A timing of switching between on and off of each of the respective switches 105 of the S/H circuits 103 is determined beforehand in accordance with an output timing of a corresponding one of the luminance signals SG1, SG2, . . . output from the DAC 74. The photosensitive drum 11 is exposed by performing writing of the luminance signals SG, charge holding, and light emission with respect to all the OLEDs 101 in units of one line in the main direction.

Figure 6A:
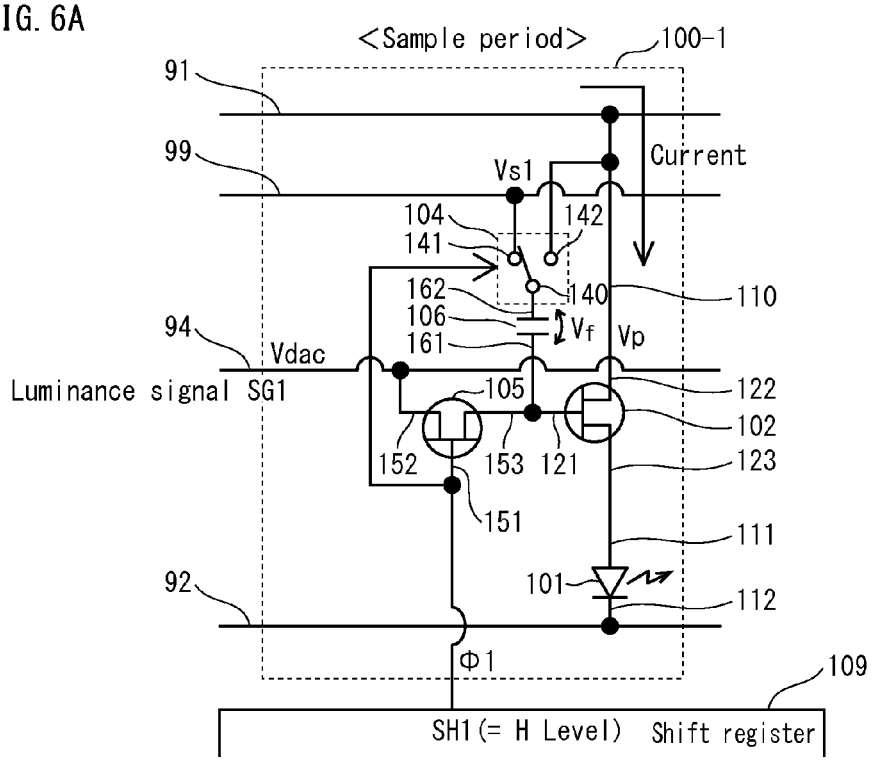
FIG. 6A shows one light-emitting unit in a sample period of a luminance signal.
Figure 6B:
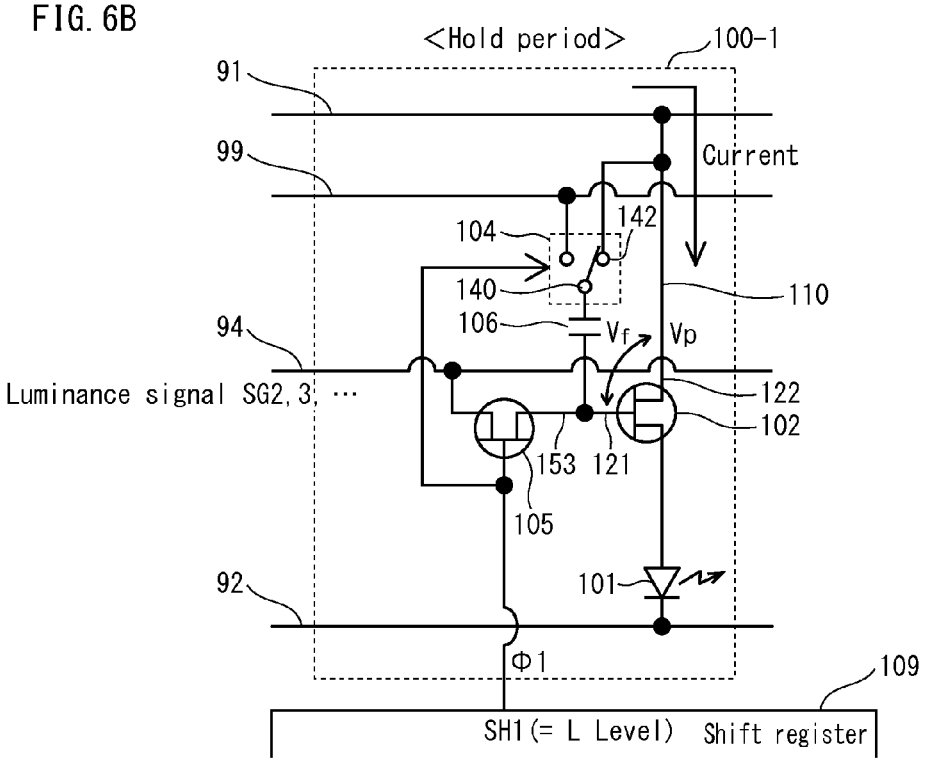
FIG. 6B shows the one light-emitting unit in a hold period of the luminance signal.

FIG. 5 shows a circuit configuration in which n (a plurality of) light-emitting units 100 that are provided on the TFT substrate 71, each of which includes the OLEDs 101. FIG. 6A is an enlarged view showing one light-emitting unit 100 in a sample period of a luminance signal, and FIG. 6B is an enlarged view showing the one light-emitting unit 100 in a hold period of the luminance signal. Note that the light-emitting units 100 in FIG. 5 each have appended thereto a number 1, 2, 3, . . . n subsequent to the reference numeral 100 for distinction therebetween. An arrangement direction of the light-emitting units 100 is the same as the main direction.

As shown in FIG. 5, the light-emitting units 100 each include, in addition to the OLED 101, the drive circuit 102, the S/H circuit 103, and a power selector switch 104.

The OLEDs 101 are each provided in a corresponding one of a plurality of current supply lines 110 via a corresponding one of the drive circuits 102. The current supply lines 110 are parallel-connected between a power line extending from the power source P (here, a power line 91) and a cathode electrode line 92 which is an earth line of the power line 91. In other words, the current supply lines 110 branch from the power line 91 at different branch positions in the longitudinal direction of thereof. Here, the power source P has a constant potential Vo.

Note that respective wiring resistances of the power line 91 and the cathode electrode line 92 are each indicated by numerical reference r in FIG. 5. Also, respective wiring resistances of other power line 99 and signal line 94, which are described later, are each similarly represented by numerical reference r. These lines have the same or different wiring resistance depending on the configuration thereof.

In the example of the circuit configuration in FIG. 5, a light-emitting unit 100-1 on the leftmost side is the shortest in wiring distance from the power source P (in length of a line part of the power line 91 from the power source P) among the light-emitting units 100, a light-emitting unit 100-2 on the right side of the light-emitting unit 100-1 is the second shortest in wiring distance, and a light-emitting unit 100 on the more right side is longer in wiring distance.

The DACs 74 are each provided between a power line 93, which extends from a power source S that is different from the power source P, and the cathode electrode line 92. The DAC 74 operates in accordance with a voltage supplied from the power source S. The DAC 74 outputs the luminance signals SG1, SG2, . . . , which are each represented by a voltage indicating a light emission amount of a corresponding one of the OLEDs 101, in order of time to the signal line 94 that extends from an output terminal 741 of the DAC 74. The power source S has the same potential as the direct-current power source P, namely, the constant potential Vo, but is hereinafter referred to as a potential Vs for distinction therebetween.

As shown in FIG. 6A, the drive circuits 102 are each a voltage input type drive circuit that includes a gate terminal 121, an input terminal 222, and an output terminal 123. The drive circuit 102 is a P-type field effect transistor (FET) here, and the input terminal 222 corresponds to a source, and the output terminal 123 corresponds to a drain.

The input terminal 122 of the drive circuit 102 is connected with the power line 91 (corresponding to a plus-side power line) via a corresponding one of the current supply lines 110. A current from the power source P is input to the input terminal 122 of the drive circuit 102 via the power line 91 and the current supply line 110.

The drive circuit 102 controls the current, which is input from the power line 91 to the input terminal 122, in accordance with a difference between a voltage of the gate terminal 121 and a voltage of the input terminal 122 (potential difference), and outputs the controlled current via the output terminal 123.

The output terminal 123 of the drive circuit 102 is connected with the cathode electrode line 92 via a corresponding one of the OLEDs 101.

The OLEDs 101 each have an anode 111 that is connected with the output terminal 123 of a corresponding one of the drive circuits 102, and a cathode 112 that is connected with the cathode electrode line 92. The OLED 101 emits light of an amount corresponding to a current supplied from the drive circuit 102.

The cathode electrode line 92 is an earth line whose one end is connected with an earth (GND in FIG. 5) that is common with the light-emitting units 100 and the DACs 74. The cathode electrode line 92 corresponds to a minus-side power line relative to the plus power line 91, which is connected with the power source P and corresponds to the plus-side power line.

The gate terminal 121 of the drive circuit 102 is connected with the signal line 94, on which the luminance signals SG1, SG2, . . . output from the DAC 74 are transmitted, via a corresponding one of the FETs 105 used as a switch element.

The FETs 105 each include a gate terminal 151, an input terminal 152, and an output terminal 153.

The input terminal 152 of the FET 105 is connected with the signal line 94. The output terminal 153 of the FET 105 is connected with the gate terminal 121 of the drive circuit 102.

The gate terminal 151 of the FET 105 is connected with an output terminal SH1 of the shift register 109. The output terminal SH1 is a terminal that outputs a pulsed signal $\phi$1 (FIG. 7) that has alternate high (H) level and low (L) level.

Only while the luminance signal SG1 is output from the DAC 74 at constant cycles, the signal $\phi$1 has H level. While other luminance signals SG2, SG3, . . . are output, the signal $\phi$1 has L level. An output timing of H level is determined beforehand so as to synchronize with an output timing of the luminance signal SG1 from the DAC 74.

The FET 105 functions such that when the signal $\phi$1 of H level is input to the gate terminal 151, the input terminal 152 and the output terminal 153 are switched to a conductive state (on), and when the signal $\phi$1 of L level is input to the gate terminal 151, the input terminal 152 and the output terminal 153 are switched to a non-conductive state (off). Note that although the FET 105 is used here as the switch element, other element having a switch function may be used. Hereinafter, the FET 105 is referred to as a switch 105.

The holding elements 106, which are each a capacitor, each have one terminal 161 that is connected with the gate terminal 121 of a corresponding one of the drive circuits 102 and other terminal 162 that is connected with a corresponding one of the power selector switches 104.

The power selector switches 104 are each a switch circuit that has a function of so-called two contacts per circuit, and each can be a circuit including an FET for example.

The power selector switch 104 has a switch function such that while the signal $\phi$1 of H level is output from the output terminal SH1 of the shift register 109, the power selector switch 104 is in a sample state (FIG. 6A), and while the signal $\phi$1 of L level is output, the power selector switch 104 is in a hold state (FIG. 6B). The sample state is a state where a contact 140 is connected with a contact 141. The hold state is a state where the contact 140 is connected with a contact 142. This switching function is provided in order to suppress unevenness in light emission amount between the OLEDs 101. Reason why the unevenness in light emission amount can be suppressed is described later.

The contact 141 of the power selector switch 104 is connected with the power line 99.

The power line 99 is wired on the same TFT substrate 71 on which the power line 91, the cathode electrode line 92, and the signal line 94 are wired. As shown in FIG. 5, the power line 99 has one end that is connected with the power line 93, and a voltage of the power source S is applied to the power line 99 via the power line 93 (a reference voltage as a reference is supplied from the power line 99 as described later).

Returning to FIG. 6A, the contact 142 of the power selector switch 104 is connected with a part of the current supply line 110 that is positioned between the power line 91 and the input terminal 122 of the drive circuit 102.

As shown in FIG. 6A, in synchronization with transmission of the luminance signal SG1 on the signal line 94, the signal ϕ1 output from the shift register 109 is switched to H level, the switch 105 is switched to the conductive state, and the power selector switch 104 is switched to the sample state. Accordingly, a first circuit is configured starting with the signal line 94 to reach the power line 99 via the switch 105, the holding element 106, and the power selector switch 104. This enables writing (sampling) of the luminance signal SG1, which is transmitted on the signal line 94, into the holding element 106.

Writing of the luminance signal SG1 is performed by charging a charge corresponding to a voltage Vf that is a difference between a voltage Vdac and a voltage Vs1. The voltage Vdac is a voltage representing the luminance signal SG applied to the one terminal 161 of the holding element 106 (corresponding to a voltage applied to the gate terminal 121 of the drive circuit 102). The voltage Vs1 is a voltage applied to the other terminal 162 of the holding element 106 (corresponding to a voltage of the power line 99).

When the signal ϕ1 output from the shift register 109 is switched from H level to L level, writing of the luminance signal SG1 completes, and the light-emitting unit 100-1 is switched to the hold period as shown in FIG. 6B where the switch 105 is in the non-conductive state and the power selector switch 104 is in the hold state. Accordingly, a second circuit is configured starting with the gate terminal 121 of the drive circuit 102 to reach the input terminal 122 of the drive circuit 102 on the current supply line 110 via the holding element 106 and the power selector switch 104.

The switch 105 is in the non-conductive state, and the output terminal 153 of the switch 105 is substantially in an open state (input of the luminance signal SG is interrupted). Accordingly, the voltage Vf between the both ends of the holding element 106, which is generated from the charge stored in the holding element 106 as a result of writing the luminance signal SG1 in an immediately previous sample period, is still maintained even in a hold period. This voltage Vf corresponds to the potential difference between the gate terminal 121 and the input terminal 122 of the drive circuit 102.

In the hold period, the drive circuit 102 supplies, to the OLED 101, the current in accordance with the voltage Vf, which is generated from the charge stored in the holding element 106 as a result of writing the luminance signal SG1 in the immediately previous sample period and corresponds to the potential difference between the gate terminal 121 and the input terminal 122.

As a result, the current, which corresponds to the light emission amount indicated by the luminance signal SG1 which is input in the sample period, is supplied to the OLED 101, and the OLED 101 is turned on with the light emission amount based on the luminance signal SG1.

In this sense, the DAC 74, the switch 105, the shift register 109, and so on can be regarded as functioning as the signal writing unit that writes the luminance signal SG into the holding element 106. Also, output of the signal ϕ1 amounts to issuance of an instruction to switch between the first circuit and the second circuit. Furthermore, the sample state shown in FIG. 6A can be regarded as a state where a voltage supplied from the power line 99 is used as the reference voltage for writing the luminance signal SG into the holding element 106. Also, the hold state shown in FIG. 6B can be regarded as a state where a voltage supplied from the power line 91 is used as a reference voltage for the voltage Vf after being held in the holding element 106 as a result of writing the luminance signal SG1.

The example in FIG. 6A shows the sample period in which the luminance signal SG1 which is output from one DAC 74 is written into the holding element 106 included in the light-emitting unit 100-1. Even in the case where the luminance signals SG2, SG3, . . . are each written into a corresponding one of the holding elements 106 included in the light-emitting units 100-2, 100-3, . . . , the same switching is performed on a corresponding one of the power selector switches 104 and a corresponding one of the switches 105.

When the luminance signal SG2 for example is output from the DAC 74 in FIG. 5, a signal ϕ2 of H level is output in synchronization with output of the luminance signal SG2 only from the output terminal SH2 among the output terminals SH1, . . . , SHn of the shift register 109. As a result, the switch 105 and the power selector switch 104 included in the light-emitting unit 100-2 among the light-emitting units 100 are switched to the conductive state and the sample state, respectively, and the luminance signal SG2 is written into the holding element 106 included in the light-emitting unit 100-2.

Only when the luminance signal SG1 for the light-emitting unit 100-1 on the leftmost side is output from the DAC 74 for example, the shift register 109 outputs, from the output terminal SH1, the signal ϕ1 of H level to the switch 105 included in the light-emitting unit 100-1. Then, only when the luminance signal SG2 for the light-emitting unit 100-2 on the second leftmost side is output from the DAC 74, the shift register 109 outputs, from the output terminal SH2, the signal ϕ2 of H level to the switch 105 included in the light-emitting unit 100-2. In this way, the shift register 109 outputs the signals ϕ1, ϕ2, . . . of H level in accordance with different timings.

When writing of the luminance signal SG1 into the light-emitting unit 100-1 completes, the switch 105 included in the light-emitting unit 100-1 is switched off, and the written luminance signal SG1 is held. Then, when the switch 105 included in the light-emitting unit 100-2 on the second leftmost side is switched on, the luminance signal SG2 is started to be written into the light-emitting unit 100-2.

In this way, the switch 105 is switched to the conductive state in synchronization with input of the luminance signal SG to be input for each of the light-emitting units 100, and the luminance signal SG is written into the holding element 106 via the switch 105. The written luminance signal SG is held from when the switch 105 is returned to the non-conductive state till when a next writing is started.

A period in which the luminance signal SG is written for each of the light-emitting units 100 corresponds to a sample period.

The length of the sample period is uniform between the light-emitting units 100. The sample period corresponds to a period in which the signal ϕ output from the shift register 109 has H level. The sample period is determined beforehand so as to have a constant length that is longer than a necessary period from start to completion of charging a charge in the holding element 106 which is a capacitor.

Accordingly, the voltage between the both ends of the holding element 106 reaches the voltage Vf, which is the difference between the voltage Vdac and the voltage Vs1, within a single sample period, and then the voltage Vf is maintained. The length of the sample period, the capacity and the time constant of the capacitor, and so on are determined beforehand such that the luminance signal SG is written in this way in each sample period for each of the light-emitting units 100.

Then, a period from completion of a sample period to start of a subsequent sample period for each of the light-emitting units 100 corresponds to a hold period in which the luminance signal SG, which is written in the sample period, is held.

Figure 7:
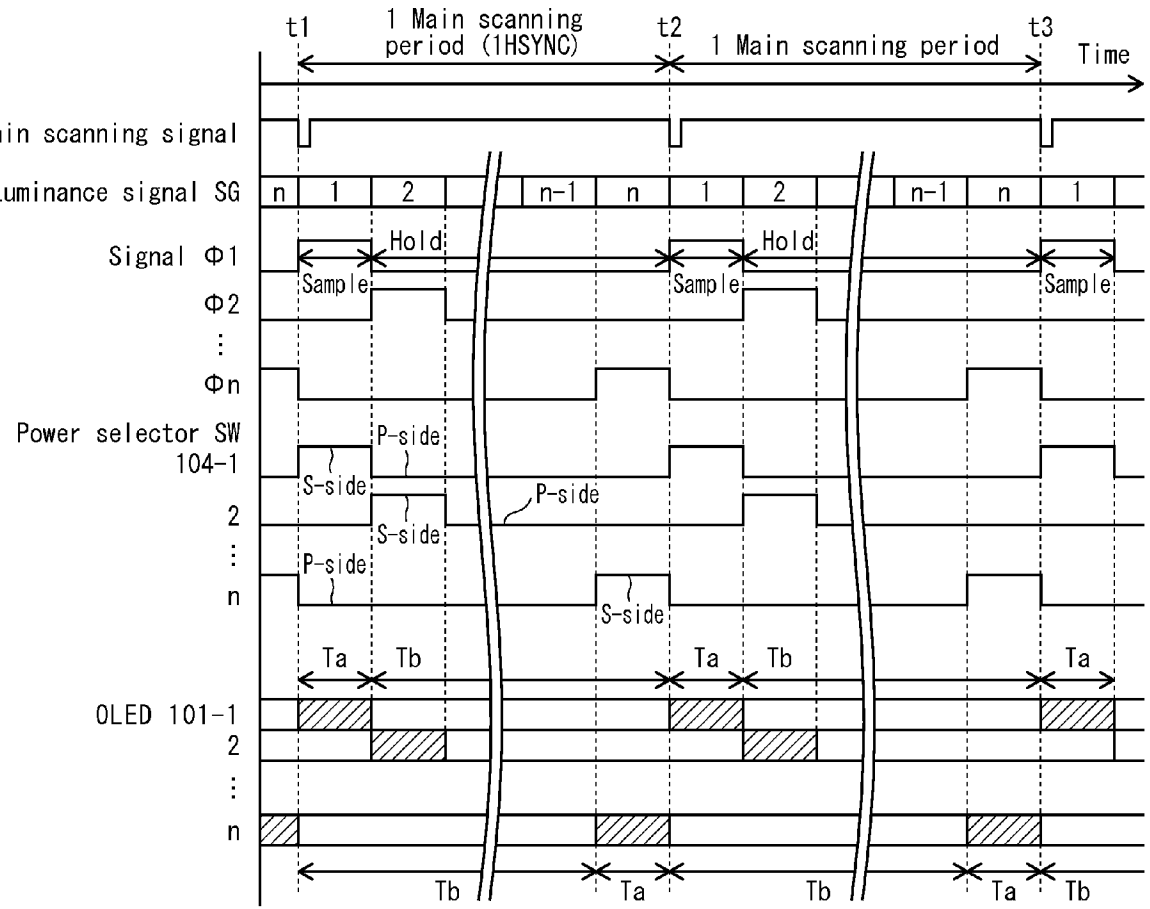
FIG. 7 is a timing chart showing sample periods and hold periods with respect to each of the light-emitting units.

FIG. 7 is a timing chart showing the sample periods and the hold periods with respect to each of the light-emitting units 100, where a method of controlling light emission from the OLEDs 101 employs a so-called rolling driving. Here, the respective OLEDs 101 and power selector switches 104 included in the light-emitting units 100 in the figure each have appended thereto a number 1, 2, 3, . . . n subsequent to the reference numerals, like the light-emitting units 100, for distinguishing to which light-emitting unit 100 each of the OLEDs 101 and power selector switches 104 belong.

As shown in the figure, while the signal ϕ1 output from the shift register 109 has H level in synchronization with output of the luminance signal SG1, only a power selector switch 104-1 is in the S-side (the sample state), and the luminance signal SG1 is written into the holding element 106 included in the light-emitting unit 100-1. This writing period of the luminance signal SG1 corresponds to a sample period Ta for the light-emitting unit 100-1.

When output of the luminance signal SG1 completes (when the signal ϕ1 switches from H level to L level), the power selector switch 104-1 is returned to the P-side (the hold state). Then, while the signal ϕ2 output from the shift register 109 has H level in synchronization with output of the luminance signal SG2, only a power selector switch 104-2 is switched to the S-side (the sample state), and the luminance signal SG2 is written into the holding element 106 included in the light-emitting unit 100-2. This writing period of the luminance signal SG2 corresponds to a sample period Ta for the light-emitting unit 100-2.

Subsequently, the luminance signals SG3, . . . , SGn are each written into the holding element 106 included in a corresponding one of the light-emitting units 100-3, . . . , **100-*n*** in accordance with a different timing.

The period in which the signal ϕ for each of the light-emitting units 100 has H level corresponds to a sample period Ta, and a period other than the sample period Ta corresponds to a hold period Tb. A single hold period Tb normally has a length approximately 100 times the length of a single sample period Ta for example.

A period from a start time t1 of a sample period Ta for the OLED 101-1 to an end time t2 of a sample period Ta for the OLED **101-*n* is defined as a single main scanning period (1HSYNC). This single main scanning period corresponds to a period for forming an electrostatic latent image for a single line on the photosensitive drum 11** in the main direction.

A single main scanning period starts when a main scanning signal switches from H level to L level at predetermined intervals.

In FIG. 7, the example is shown in which one DAC 74 outputs each of the luminance signals SG1, SG2, . . . , SGn to a corresponding one of the n light-emitting units 100 in accordance with a different timing. In the case where the number of DACs 74 is plural, operations of outputting the luminance signal SG to a corresponding light-emitting unit 100 and sampling and holding the luminance signal SG are performed by the DACs 74 in parallel.

After the single main scanning period (from time t1 to time t2) ends, a subsequent main scanning period (from time t2 to time t3) starts. The main scanning period is repeatedly shifted in this way, and as a result an electrostatic latent image for a single line in the main direction is formed on the rotating photosensitive drum 11 for each main scanning period. Accordingly, an electrostatic latent image corresponding to a single page image is formed in a rotation direction of the photosensitive drum 11 (a sub scanning direction).

Figure 8:
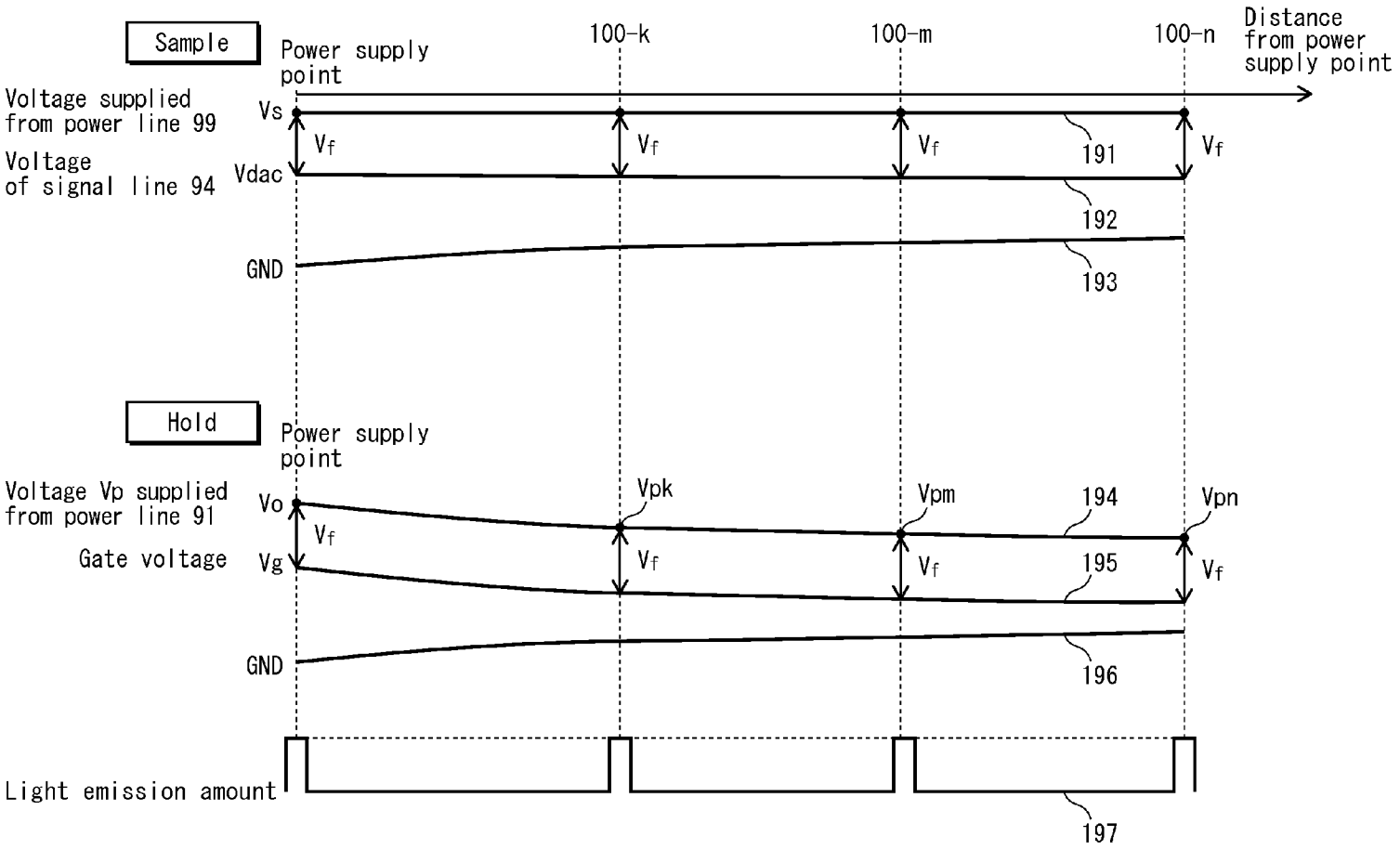

FIG. 8 illustrates graphs 191 to 197 each representing a relation between a wiring distance from a power supply point to each of the light-emitting units 100 and a potential drop in a sample period or a hold period under the situation where all the OLEDs 101 are turned on, and so on.

Specifically, the graph 191 represents a relation in the sample period between a voltage supplied from the power line 99 to each of the light-emitting units 100 and the wiring distance from the power supply point (the power source S).

The graph 192 represents a relation in the sample period between the voltage representing the luminance signal SG input from the signal line 94 to each of the light-emitting units 100 and the wiring distance from the power supply point (the DAC 74).

The graph 193 represents a relation in the sample period between the wiring distance on the cathode electrode line 92 from the power supply point (earth: GND) and the potential drop.

The graph 194 represents a relation in the hold period between a voltage Vp supplied from the power line 91 to each of the light-emitting units 100 and the wiring distance from the power supply point (the power source P).

The graph 195 represents a state in the hold period where a voltage of the gate terminal 121 of each of the drive circuits 102 varies in accordance with the wiring distance.

The graph 196 represents a relation in the hold period between the wiring distance on the cathode electrode line 92 from the power supply point (earth: GND) and the potential drop.

The graph 197 represents a state in the hold period where the light emission amount of each of the OLEDs 101 does not vary in accordance with the wiring distance (the difference in wiring distance from the power supply point between the light-emitting units 100 does not cause unevenness in light emission amount between the OLEDs 101).

In the figure, one of the n light-emitting units 100 that has some short wiring distance on the power line 91 from the power source P is represented as a light-emitting unit **100-*k*, one of the n light-emitting units 100 that has the longest wiring distance on the power line 91 from the power source P is represented as a light-emitting unit 100-*n*, and one of the n light-emitting units 100 that is positioned between the light-emitting unit 100-*k* and the light-emitting unit 100-*n* is represented as a light-emitting unit 100-*m***.

From the graph 191 relating to the sample period, it is found that the voltage supplied from the power line 99 to each of the light-emitting units 100 is a voltage Vs that is substantially constant regardless of the wiring distance from the power source S which is the power supply point. This is because of the following reason.

Specifically, as shown in FIG. 5, FIG. 6A, and FIG. 6B, the one end of the power line 99 is connected with the power source S via the power line 93. On the side of the other end of the power line 99 on the other hand, the power line 99 branches at different positions one-to-one corresponding to the n light-emitting units 100, and respective front ends of lines resulting from the branching are each connected with the contact 141 of the power selector switch 104 included in a corresponding one of the light-emitting units 100.

The following description is given focusing on one light-emitting unit 100. At the start time of the sample period, the contacts 141 and 140 of the power selector switch 104 are connected. Furthermore, when the switch 105 is switched to the conductive state, the first circuit is formed, as described above, starting with the signal line 94 to reach the power line 99 via the switch 105, the holding element 106, and the power selector switch 104. A current, which corresponds to the voltage between the both ends of the holding element 106, flows through the holding element 106 (corresponding to charging and discharging of a charge into the holding element 106).

At this time, there is a case where a potential drop temporarily occurs on the power line 99 due to a wiring resistance r in accordance with an amount of the flowing current. However, after the charging and discharging of the charge into the holding element 106 completes, the current does not flow through the holding element 106 anymore. As a result, the potential drop on the power line 99 ceases by the end time of the sample period, and the potential on the power line 99 is restored to a voltage that is substantially the same as the voltage Vs. The figures show the state where the potential on the power line 99 is restored to the voltage Vs.

Note that there is a case where a minute current flows through the holding element 106 depending on a device configuration and as a result a potential drop hardly occurs on the power line 99. The same applies to the other light-emitting units 100. In other words, it is possible to write the luminance signal SG for each of all the light-emitting units 100 in the sample period under the same conditions for the potential on the power line 99.

In the hold period compared with this, since the contacts 141 and 140 of the power selector switch 104 included in each of all the light-emitting units 100 are not connected, and the respective front ends of the lines, which result from the branching and one-to-one correspond to all the light-emitting units 100, are substantially in the open state, no potential drop occurs on the power line 99.

Also, since the input terminal of each of the DACs 74 here has an extremely high input impedance, a current hardly flows through the DAC 74 from the power line 93.

Accordingly, even if a wiring resistance r occurs on the power line 99, no potential drop due to the wiring resistance r substantially occurs while a current hardly flows through the power line 99, or a potential drop due to the wiring resistance r occurs only to an extent that the potential drop is ignorable. Therefore, the voltage supplied from the power line 99 to each of the light-emitting units 100 is substantially the constant Vs regardless of the wiring distance from the power source S.

In the above configuration, the power line 99 is connected with the power source S via the power line 93. Alternatively, the power line 99 may for example be directly connected with the power source S.

Returning to FIG. 8, from the graph 192 relating to the sample period, it is found that the voltage of the signal line 94 is a voltage Vdac that is substantially constant, like that represented by the graph 191. This is because of the following reason.

Specifically, as shown in FIG. 5, FIG. 6A, and FIG. 6B, the one end of the signal line 94 is connected with the output terminal 741 of the DAC 74. On the side of the other end of the signal line 94 on the other hand, the signal line 94 branches at different positions one-to-one corresponding to the n light-emitting units 100, like the power line 99, and respective front ends of lines resulting from the branching are each connected to the one terminal 161 of the holding element 106 and the gate terminal 121 of the drive circuit 102 via the switch 105 included in a corresponding one of the light-emitting units 100.

Since the holding element 106 is a capacitor, when the switch 105 is switched to the conductive state at the start of the sample period, charging and discharging of a charge into the holding element 106 is performed such as described above. As a result, there is a case where a potential drop temporarily occurs on the signal line 94 due to a wiring resistance r. Even if such a potential drop occurs, the current does not flow through the holding element 106 anymore after the charging and discharging of the charge into the holding element 106 completes, like in the above case of the power line 99. Accordingly, the potential drop on the signal line 94 ceases by the end time of the sample period.

Also, since the drive circuit 102 is an FET, when the luminance signal SG is applied to the gate terminal 121 of the drive circuit 102 via the switch 105, a current hardly flows from the gate terminal 121 to the input terminal 122 and the output terminal 123.

In the hold period compared with this, the switch 105 included in each of all the light-emitting units 100 is switched to the non-conductive state. Accordingly, no current flows through the holding element 106 from the signal line 94 via the switch 105, and therefore no potential drop occur on the signal line 94.

Also, the luminance signals SG1, SG2, . . . , n are represented by the same voltage Vdac under the situation where all the OLEDs 101 are turned on.

Accordingly, even if a wiring resistance r occurs on the power line 94, no potential drop due to the wiring resistance r substantially occurs while a current hardly flows through the power line 94, or a potential drop occurs due to the wiring resistance r only to an extent that the potential drop is ignorable.

Therefore, as shown in FIG. 8, the light-emitting units 100-*k*, 100-*m*, and 100-*n*, which differ from each other in wiring distance from the power supply point, have the same voltage Vf in the sample period which is the difference between the voltage supplied from the power line 99 and the voltage Vdac representing the luminance signal SG transmitted on the signal line 94. The same applies to the other light-emitting units 100.

In this way, all the n light-emitting units 100 have the same voltage Vf between the both ends of the holding element 106, and a charge corresponding to this voltage Vf is stored in the holding element 106 included in each of all the n light-emitting units 100. This voltage Vf is a voltage corresponding to the magnitude of the light emission amount indicated by the luminance signal SG, and is indexed by a storage amount of the charge.

Next, from the graph 193 relating to the sample period, it is found that as the wiring distance on the cathode electrode line 92 from the earth (GND) increases (as the light-emitting unit 100 is more distant from the GND), the voltage on the cathode electrode line 92 increases.

This is because a current from the power line 91 flows through the cathode electrode line 92 via each of the OLEDs 101 even in the sample period, and an influence is exercised by a potential drop on the cathode electrode line 92 due to the wiring resistance r caused by a current flowing through the cathode electrode line 92. As found from the graph 196 relating to the hold period, this potential drop similarly occurs on the cathode electrode line 92 even in the hold period due to the current flowing through the cathode electrode line 92.

From the graph 194 relating to the hold period on the other hand, it is found that as the wiring distance on the power line 91 from the power source P which is the power supply point increases, the voltage Vp supplied from the power line 91 to each the light-emitting units 100 decreases.

This is because an influence is exercised by a potential drop on the power line 91 due to the wiring resistance r caused by a current flowing on the power line 91 for supply of the current to each of the OLEDs 101.

As the wiring distance from the power source P increases, the amount of voltage decrease due to a potential drop increases. Accordingly, a relation Vo>Vpk>Vpm>Vpn is satisfied, where Vpk expresses a voltage that is input (applied) to the input terminal 122 of the drive circuit 102 included in the light-emitting unit 100-*k* from the power line 91 in the hold period, Vpm expresses a voltage that is input to the input terminal 122 of the drive circuit 102 included in the light-emitting unit 100-*m* from the power line 91 in the hold period, and Vpn expresses a voltage that is input to the input terminal 122 of the drive circuit 102 included in the light-emitting unit 100-*n* from the power line 91 in the hold period.

Furthermore, from the graph 195 relating to the hold period, it is found that a voltage resulting from subtracting the voltage Vf from the voltage Vp supplied from the power line 91 is the voltage Vg (the gate voltage) of the gate terminal 121 of the drive circuit 102 included in each of the light-emitting units 100. This is because of the following reason.

In other words, the voltage Vf generated from the charge which is stored in the holding element 106 in a sample period is equal to the voltage between the both ends of the holding element 106 as shown in FIG. 6A, and the voltage Vf is held in the holding element 106 in an immediately subsequent hold period.

As a result, as shown in FIG. 6B, when the power selector switch 104 is switched to the hold state in the hold period, a potential difference corresponding to the voltage Vf occurs between the input terminal 122 and the gate terminal 121 of the drive circuit 102.

The same applies to the other light-emitting units 100. This is because the voltage Vf is offset from the voltage Vp which is input to the input terminal 122, and as a result the voltage of the gate terminal 121 decreases by the voltage Vf with reference to the voltage Vp.

Therefore, even in the case where the voltage Vp, which is input from the power line 91 to the drive circuit 102, differs between the light-emitting units 100 due to the difference in wiring distance from the power supply point between the light-emitting units 100, the potential difference between the input terminal 122 and the gate terminal 121 of the drive circuit 102 has the uniform voltage Vf between the light-emitting units 100.

As described above, the drive circuits 102 are each a circuit that outputs a current in accordance with the difference between the voltage of the input terminal 122 and the voltage of the gate terminal 121 of the drive circuit 102.

Accordingly, when the potential difference between the input terminal 122 and the gate terminal 121 of the drive circuit 102 in the hold period is the uniform voltage Vf between the light-emitting units 100, this means that a uniform current flows through the OLEDs 101. Under the situation where all the OLEDs 101 are turned on, the respective OLEDs 101 included in the light-emitting units 100 are turned on with a uniform light emission amount.

The graph 197 represents an example in which the respective light emission amounts of the three representative light-emitting units 100-*k*, 100-*m*, and 100-*n* among the light-emitting units 100 are equal to a light emission amount of a light-emitting unit that is assumed to be provided on the power supply point.

In this way, it is possible to write the luminance signal SG into the holding element 106 in the sample period of the luminance signal SG for each of the light-emitting units 100, with use of the voltage Vs of the power line 99, which is independent of the power line 91 and is not influenced by the potential drop due to the wiring resistance r caused by the current flowing through the power line 91.

The luminance signal SG is written into the holding element 106 by storing a charge having an amount corresponding to the voltage representing the luminance signal SG (the voltage indicating the light emission amount) in the holding element 106. The amount of the charge stored in the holding element 106 is determined in accordance with the voltage between the both ends of the holding element 106, namely, the difference between the voltage applied to the one terminal 161 and the voltage applied to the other terminal 162.

Accordingly, in the case where the voltage applied to the other terminal 162 of the holding element 106 is constant as the reference voltage that is the reference when writing the luminance signal SG into the holding element 106, it is possible to, in the holding element 106, precisely store the charge having an amount corresponding to the difference from the voltage represented by the luminance signal SG for each writing of the luminance signal SG. The other terminal 162 is one of the two terminals of the holding element 106, and is opposite to the one terminal 161 to which the voltage representing the luminance signal SG is applied.

In the case where, for example, the luminance signal SG indicated by the same voltage is written each time under the situation where all the OLEDs 101 are turned on, a charge having the same amount is stored in the holding element 106 for each writing. Accordingly, the voltage Vf between the both ends of the holding element 106 is uniform between the light-emitting units 100, and no difference in the voltage Vf occurs between the light-emitting units 100.

Figure 9:
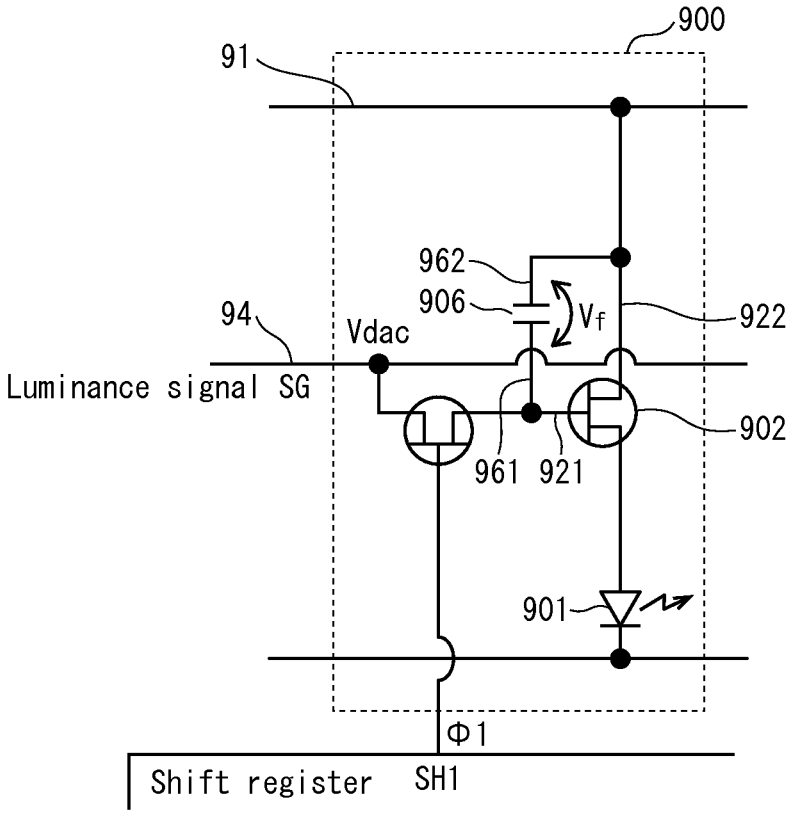
FIG. 9 shows a circuit configuration relating to a comparative example.

Compared with this, in the case where a circuit configuration of a comparative example shown in FIG. 9 is adopted for example in which one terminal 961 of a holding element 906 is connected with a gate terminal 921 of a drive circuit 902 and the other terminal 962 of the holding element 906 is connected with an input terminal 922 of the driving circuit 902, a voltage supplied from the power line 91 is always applied to the other terminal 962 of the holding element 906.

According to this comparative example, a voltage, which is applied to the one terminal 962 of the holding element 906 included in each of light-emitting units 900, decreases as a distance of the light-emitting unit 900 from the power supply point increases. This is due to a potential drop on the power line 91 (see the graph 194 in FIG. 8).

That is, the reference voltage for writing the luminance signal SG into the holding element 106 (the voltage applied to the terminal 962 of the holding element 906) differs between the light-emitting units 900.

According to the configuration of the comparative example, therefore, even if the voltage Vdac representing the luminance signal SG transmitted on the signal line 94 is uniform between the light-emitting units 900, an amount of a charge stored in the holding element 906 differs between the light-emitting units 900 by the difference in voltage applied to the terminal 962 of the holding element 906 due to the potential drop on the power line 91. In other words, the voltage Vf between the both ends of the holding element 906 differs between the light-emitting units 900.

This means that even if the luminance signal SG indicating the same light emission amount is input to each of the light-emitting unit 900 (even if the voltage Vdac is uniform between the light-emitting units 900), there is unevenness in light emission amount between the OLEDs 901.

According to the configuration of the examples shown in FIG. 6A and FIG. 6B, on the other hand, the reference voltage (the voltage of the power line 99) is uniform between the light-emitting units 100 as described above. This prevents unevenness in light emission amount between the OLEDs 101 due to the potential drop caused by the difference in wiring distance between the light-emitting units 100.

Also, the power source S, to which the power line 99 is connected, is the driving source of the DACs 74 as shown in FIG. 5, and is an existing one. Accordingly, it is not necessary to provide a new power terminal or the like for the power line 99 on the TFT substrate 71, thereby simplifying the circuit configuration.

Although the above description has been given of the example under the situation where all the OLEDs 101 are turned on, the number of the OLEDs 101 to emit light in a single main scanning period might often be for example at least one and less than n depending on an image to be reproduced.

In this case, the magnitude of a potential drop on the power line 91 due to the wiring distance from the power supply point varies depending on which one of the n OLEDs 101 emits light. In this case, the respective shapes of the graphs 194 and 196 shown in FIG. 8 differ from the original ones.

However, even if the magnitude of the potential drop on the power line 91 varies due to change of the number of the OLEDs 101 to emit light, the power line 99 is not influenced by the variation of the potential drop on the power line 91.

Therefore, even under the situation where not all the OLEDs 101 are turned on, a voltage that is substantially the same as the voltage Vs is supplied to each of all the light-emitting units 100 from the power line 99 regardless of the wiring distance from the power supply point, as represented by the graph 191 in FIG. 8.

This allows writing of the luminance signal SG into each of the light-emitting units 100 under the same condition of the uniform reference voltage, and prevents unevenness in light emission amount between the OLEDs 101 due to the potential drop on the power line 91.

Also, since the configuration is adopted in which the power line 99 is wired on the same TFT substrate 71 on which the power line 91 and so on are wired, it is possible to simplify the circuit configuration compared with the configuration in which the power line 99 is wired on a member other than the TFT substrate 71 such as the sealing plate 72, thereby reducing the manufacturing cost.

Embodiment 2

In the above Embodiment 1, the circuit configuration is adopted in which a current flows through each of the OLEDs 101 even in the sample period of the luminance signal SG. In the present Embodiment 2 compared with this, a circuit configuration is adopted in which switch is made between an interrupt state where a current supply path to the OLED 101 is forcibly interrupted in the sample period and a supply state where a current flows through the OLED 101 only in the hold period. Embodiment 2 differs from Embodiment 1 in this point. Hereinafter, description of the same configuration as that in Embodiment 1 is omitted and the same compositional elements as those in Embodiment 1 have the same numerical references in order to avoid duplicate description.

Figure 10:
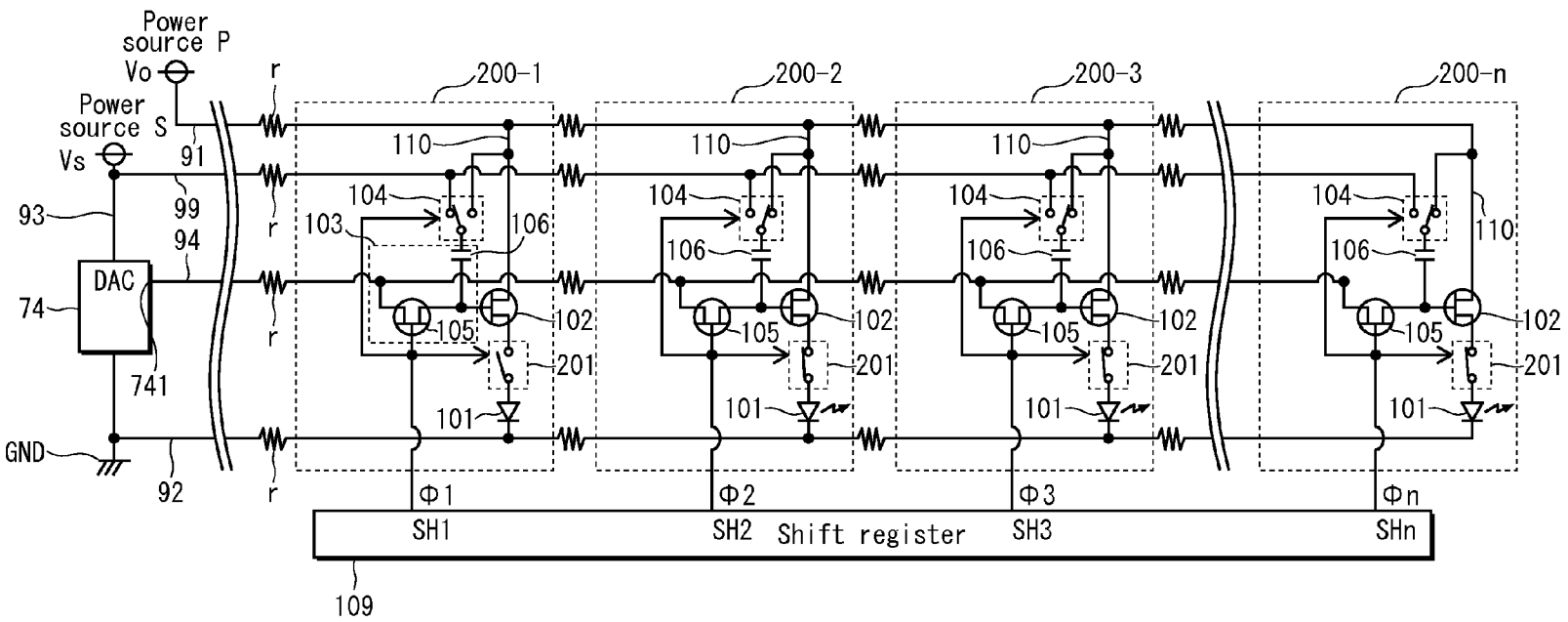
FIG. 10 shows a circuit configuration example of light-emitting units relating to Embodiment 2.
Figure 11:
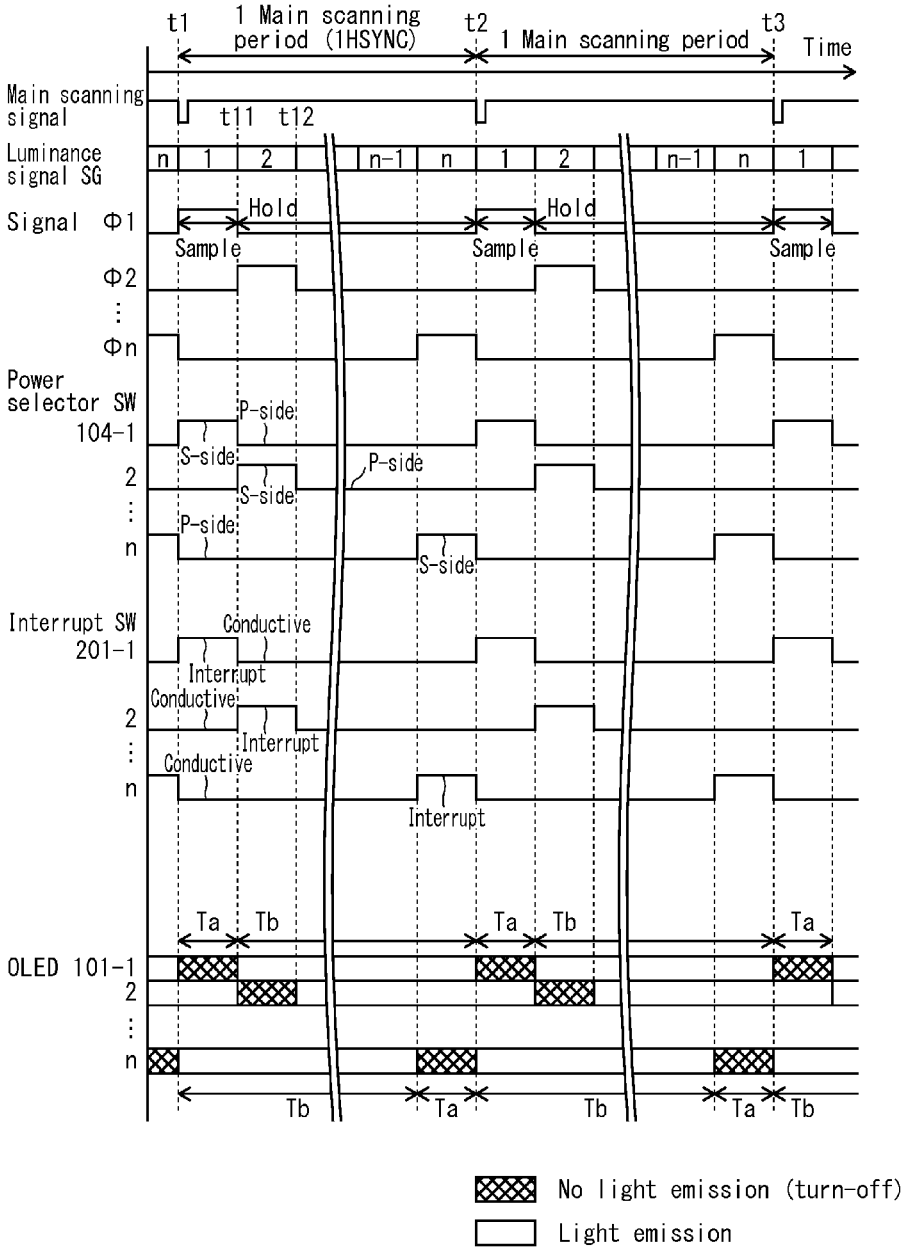
FIG. 11 is a timing chart showing operations of the light-emitting units.

FIG. 10 shows a circuit configuration example of light-emitting units 200 relating to Embodiment 2. FIG. 11 is a timing chart showing operations of the light-emitting units 200.

As shown in FIG. 10, an interrupt switch 201 is provided between the drive circuit 102 and the OLED 101 for each of the light-emitting units 200-1, 200-2, . . . , **200-*n***.

The interrupt switch 201 switches between conduction and interrupt in accordance with the signal ϕ output from the shift register 109. The interrupt switch 201 is for example an FET. When the signal ϕ has H level, the interrupt switch 201 switches to an interrupt state. When the signal ϕ has L level, the interrupt switch 201 switches to a conduction state.

In the example shown in the figure, the light-emitting unit 200-1 is in the interrupt state while the other light-emitting units 200-2, 200-3, . . . , **200-*n*** are in the conduction state.

As described in Embodiment 1, a period in which the signal ϕ output from the shift register 109 has H level corresponds to a sample period of the signal SG, and a period in which the signal ϕ output from the shift register 109 has L level corresponds to a hold period of the signal SG.

Accordingly, as shown in FIG. 11, when the signal ϕ1 is switched to H level (from time t1 to time t11) for example, a power selector switch 104-1 and an interrupt switch 201-1 of the light-emitting unit 200-1 are switched to the S-side (sample state) and the interrupt state, respectively. As a result, while the luminance signal SG1 is written (sampled) into the holding element 106, a current supply path from the power line 91 to the OLED 101 of the light-emitting unit 200-1 is interrupted, and the OLED 101 is forcibly caused not to emit light (turned off).

At this time, the signal ϕ for each of the other light-emitting units 200-2, . . . , **200-*n* has L level, and accordingly the power selector switch 104 and the interrupt switch 201 are switched to the P-side (hold state) and the conduction state, respectively. In this hold period Tb like in Embodiment 1, a current flows through the OLED 101, and the OLED 101 emits light. This flowing current corresponds to a difference between the voltage of the gate terminal 121 and the voltage of the input terminal 122 of the drive circuit 102 which is generated from a charge stored in the holding element 106** in an immediately previous sample period Ta.

Subsequently, when the signal ϕ2 output from the shift register 109 is switched to H level (from time t11 to time t12), the power selector switch 104-2 and the interrupt switch 201-2 of the light-emitting unit 200-2 are switched to the S-side (sample state) and the interrupt state, respectively. As a result, while the luminance signal SG2 is written (sampled) into the holding element 106 of the light-emitting unit 200-2, a current supply path to the OLED 101 of the light-emitting unit 200-2 is interrupted, and the OLED 101 is forcibly caused not to emit light. Note that, in the period from time t11 to time t12, the other light-emitting units 200-1, 200-3, . . . , **200-*n* each emit light with no interrupt of the respective current supply paths to the OLEDs 101**.

Subsequently, for each time the signals ϕ3, . . . , ϕn output from the shift register 109 are successively switched to H level, the respective current supply paths to the OLEDs 101 included in the light-emitting units 200-3, . . . , **200-*n*** are interrupted one by one in order only in the sample period Ta.

The current supply path to the OLED 101 for each of the n light-emitting units 200 is interrupted in the sample period Ta because of the following reason.

According to a configuration in which the current supply path to the OLED 101 is not interrupted in the sample period Ta, a light emission amount of the OLED 101 is sometimes slightly lower in a sample period Ta than in an immediately subsequent hold period Tb as described below.

The sample period Ta is extremely shorter than the hold period Tb (for example, approximately one-hundredth as long as the hold period Tb) as described above. Also, the light emission amount decreases only to a minute extent in the sample period Ta. Accordingly, these two points hardly deteriorate the image quality of reproduced images under normal circumstances.

In an image forming apparatus that is demanded to perform printing with an extremely high image quality, however, if there is even a minute unevenness in light emission decrease amount in the sample period Ta between the light-emitting units 200, the image quality of reproduced images might be deteriorated due to this unevenness in light emission amount.

In view of this problem, Embodiment 2 prevents unevenness in light emission amount between the light-emitting units 200 in the sample period Ta by forcibly controlling the respective OLEDs 101 included in the light-emitting units 200 to turn off in the sample period Ta.

Figure 12:
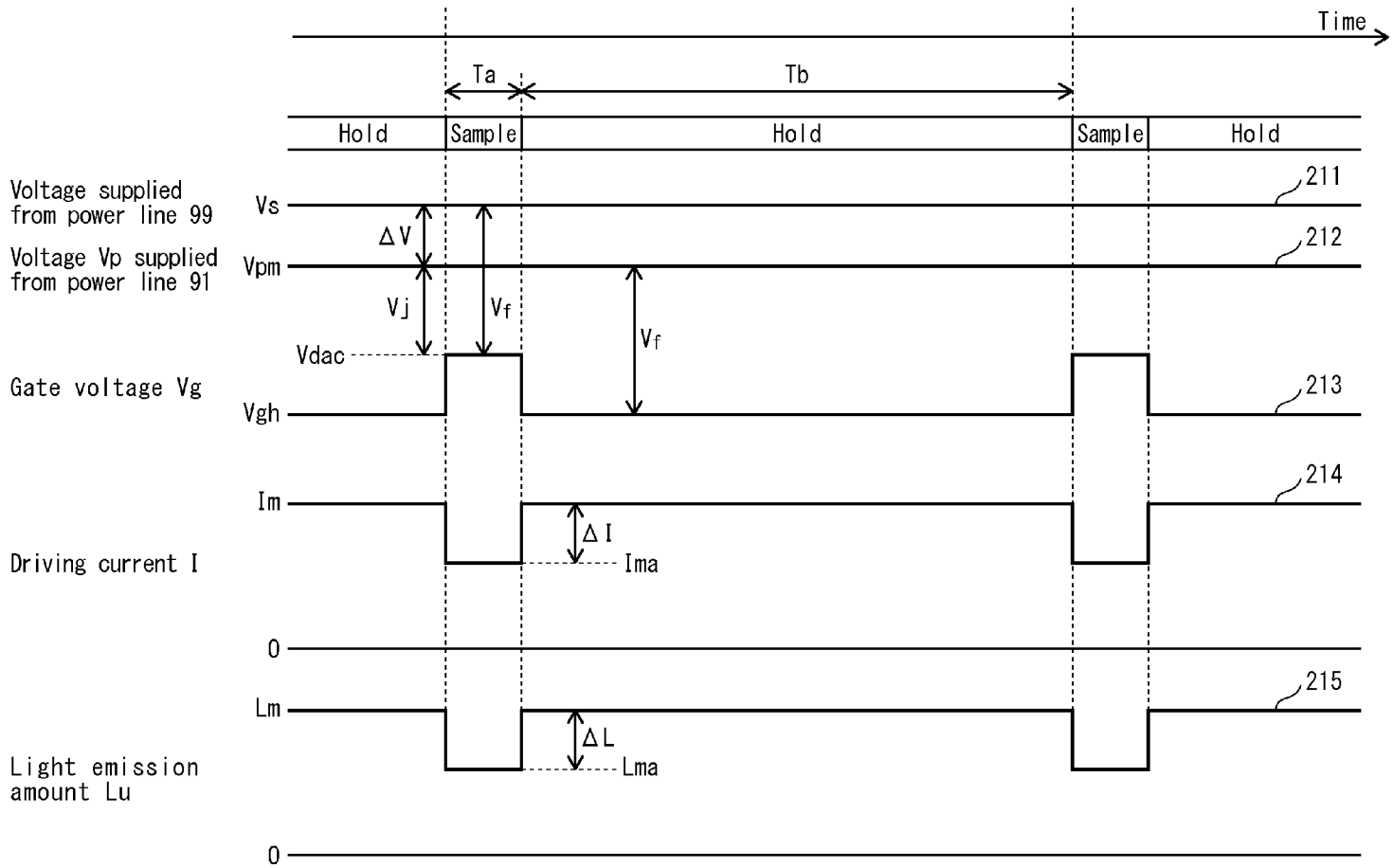
FIG. 12 is a timing chart showing that a light emission amount of each of the OLEDs is lower in a sample period than in an immediately subsequent hold period.

FIG. 12 is a timing chart showing that a light emission amount of each of the OLEDs 101 is lower in a sample period Ta than in an immediately subsequent hold period Tb.

The figure focuses on a light-emitting unit 200-*m* among the n light-emitting units 200 which are all turned on based on the assumption of a configuration example in which a current flows through each of the OLEDs 101 even in a sample period Ta. In the figure, graphs 211 to 215 represent respective transitions of a voltage Vs supplied from the power line 99, a voltage Vp supplied from the power line 91, a gate voltage Vg, a current I flowing through the OLED 101 (driving current), and a light emission amount Lu in sample periods Ta and hold periods Tb.

Here, the voltage Vs, which is supplied from the power line 99, corresponds to a voltage applied to the holding element 106 from the power line 99 via the power selector switch 104, and the voltage Vp, which is supplied from the power line 91, corresponds to a voltage Vpm applied to the input terminal 122 of the drive circuit 102 from the power line 91.

The voltage Vs, which is supplied from the power line 99, is substantially constant between the sample periods Ta and the hold periods Tb, as represented by the graph 211.

The voltage Vpm, which is supplied from the power line 91, is lower than the supplied voltage Vs by a voltage ΔV, as represented by the graph 212. This is caused by a potential drop due to a current flowing through the power line 91. Since the power sources P and S have the same voltage as described above, voltage decrease due to the potential drop corresponds to the voltage ΔV. In the example shown in the figure, the voltage ΔV is constant between the sample periods Ta and the hold periods Tb.

The gate voltage Vg in the sample periods Ta is equal to a voltage Vdac representing a luminance signal SGm. A difference between the voltage Vdac and the voltage Vs in the sample periods Ta is equal to the voltage Vf between the both ends of the holding element 106.

On the other hand, the gate voltage Vg in the hold periods Tb is equal to a voltage Vgh that results from subtracting the voltage Vf from the voltage Vpm which is supplied from the power line 91. This is because of the following reason. In the hold periods Tb as shown in FIG. 6B, since the voltage between the both ends of the holding element 106 is switched by the power selector switch 104 to a voltage to be supplied to between the gate terminal 121 and the input terminal 122 of the drive circuit 102, the voltage Vf between the both ends of the holding element 106 is offset, and as a result the gate voltage Vgh is lower than the voltage Vpm of the input terminal 122.

The drive circuit 102 supplies, as a driving current I, a current in accordance with a difference between the gate voltage Vg and the voltage Vpm of the input terminal 122 to the OLED 101. Accordingly, a light emission amount Lm of the OLED 101 is determined in accordance with this voltage difference. This voltage difference in the sample periods Ta is equal to a voltage Vj that is a difference between the voltage Vpm and the voltage Vdac, which differs from the voltage Vf in the hold periods Tb.

The voltage Vf in the hold periods Tb corresponds to the light emission amount indicated by the luminance signal SGm. Accordingly, an original current Im corresponding to the voltage Vf is supplied from the drive circuit 102 to the OLED 101 in the hold periods Tb, as represented by the graph 214.

Compared with this, a current Ima corresponding to the voltage Vj which is lower than the voltage Vf is supplied to the OLED 101 in the sample periods Ta.

The drive circuit 102 is configured to supply an increased current to the OLED 101 as the difference between the gate voltage Vg and the voltage Vpm of the input terminal 122 increases. Accordingly, the following relation is satisfied that when the voltage Vj<the voltage Vf, the current Im>the current Ima.

The OLED 101 has properties that as the supply current I increases, the light emission amount Lu increases. Accordingly, as represented by the graph 215, while the light emission amount Lu of the OLED 101 in the hold periods Tb has a value Lm, which is the original target light emission amount indicated by the luminance signal SG, the light emission amount Lu in the sample periods Ta has a value Lma, which is lower than the value Lm by a light emission amount corresponding to a current difference ΔI between the current Im and the current Ima.

This light emission amount difference ΔL of the light emission amount Lu between the sample periods Ta and the hold periods Tb increases as the wiring distance of each of the n light-emitting units 200 on the power line 91 from the power supply point increases. This is because of the following reason.

Specifically, as the wiring distance of each of the light-emitting units 200 from the power supply point increases, an amount of voltage decrease due to its potential drop increases, and as a result the voltage Vp supplied from the power line 91 decreases. Accordingly, if the voltage Vdac representing the luminance signal SG is constant and uniform between the light-emitting units 200, the voltage Vj in the sample periods Ta decreases.

The decrease of the voltage Vj means that the difference decreases between the gate voltage Vg of the drive circuit 102 and the voltage Vp of the input terminal 122 of the drive circuit 102. As this voltage difference decreases, the current I supplied to the OLED 101 decreases (the current difference ΔI increases). As a result, the light emission amount difference ΔL from the light emission amount Lm in the hold periods Tb increases. Therefore, the current difference ΔI increases as the wiring distance on the power line 91 from the power supply point increases.

In this way, a phenomenon occurs that the light emission amount of the OLED 101 of each of the n light-emitting units 200 is lower in the sample periods Ta than in the hold periods Tb, and the light emission amount difference ΔL therebetween differs between the light-emitting units 200 due to the difference in wiring distance from the power supply point between the n light-emitting units 200.

This phenomenon occurs only in the sample periods Ta which are extremely shorter than the hold periods Tb, and unevenness in light emission amount occurs only to a minute degree. However, there is a case where the unevenness in light emission amount influences the image quality of reproduced images in an image forming apparatus that is demanded to perform printing with an extremely high image quality such as described above.

In the case where the influence exercised on the image quality of reproduced images is caused by the unevenness in light emission amount in the sample periods Ta, it is possible to eliminate the unevenness in light emission amount by prohibiting light emission from the OLEDs 101 in the sample periods Ta in which the unevenness in light emission amount occurs. As a result, the image quality of reproduced images cannot be influenced by the unevenness anymore.

According to the present Embodiment 2 in view of this, an interrupt switch 201 is provided between the drive circuit 102 and the OLED 101 for each of the light-emitting units 200, as shown in FIG. 10. A control is performed by operations of the interrupt switch 201 to interrupt a current supply path from the drive circuit 102 to the OLED 101, that is, forcibly turn off the OLED 101, only in the sample periods.

Figure 13:
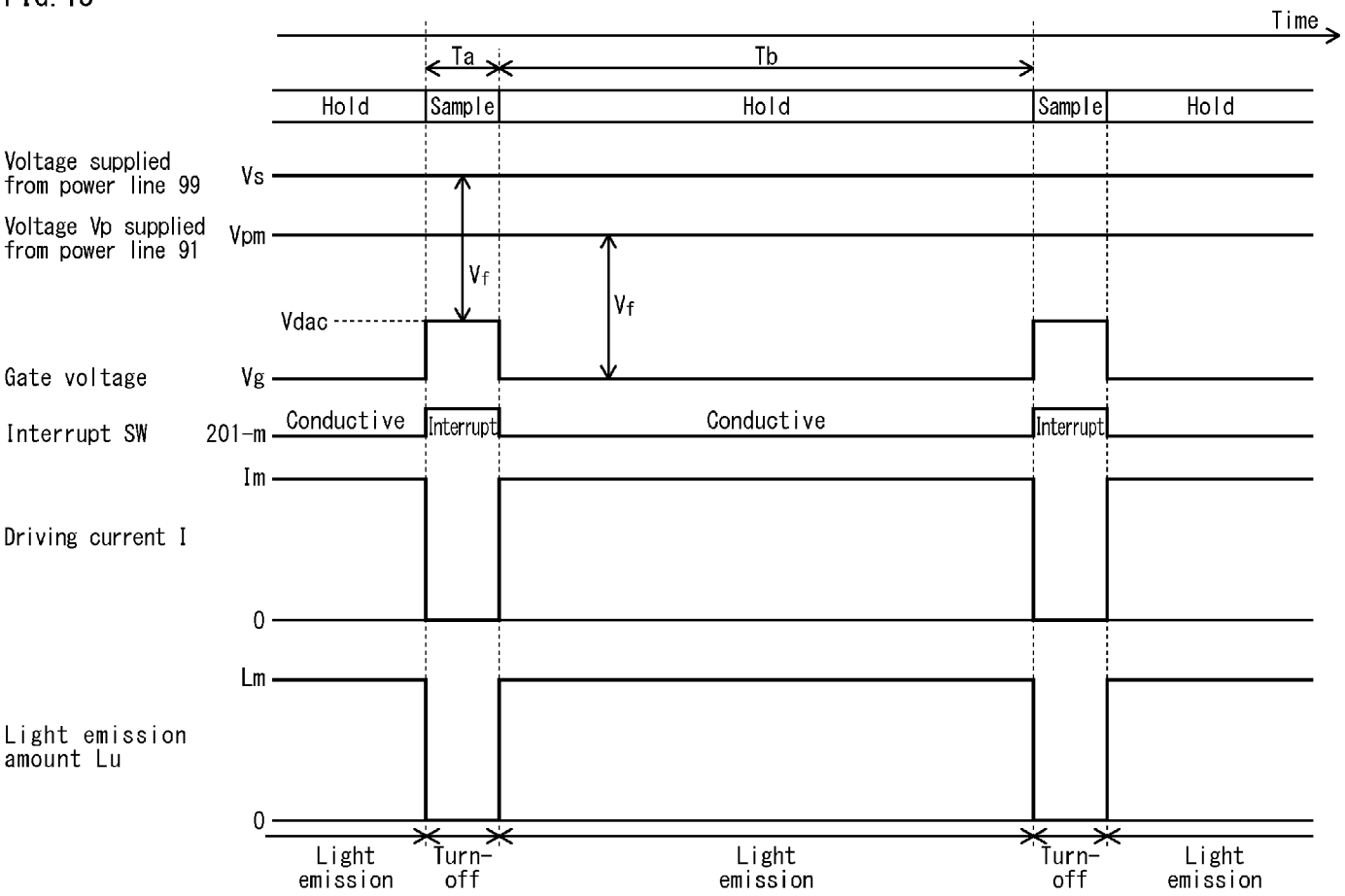

FIG. 13 is a timing chart in the case where a control is performed for interrupting a current supply path to the OLED 101 included in the light-emitting unit 200-*m* only in sample periods Ta under the situation where all the OLEDs 101 are turned on. This control is performed by switching the interrupt switch 201 included in the light-emitting unit 200-*m* to the interrupt state only in the sample periods Ta.

As shown in the figure, it is found that a driving current I of the OLED 101 is zero, that is, the OLED 101 is turned off in the sample periods Ta.

Each time a sample period Ta comes for each of the n light-emitting units 200, this forcible turn-off of the OLED 101 is performed from the start to the end of the sample period Ta.

This prevents deterioration of the image quality of reproduced images due to the unevenness such as shown in FIG. 12 in light emission amount decrease ΔL in the sample periods Ta between the OLEDs 101 included in the light-emitting units 200, which is caused by the potential drop on the power line 91. Accordingly, it is possible to obtain reproduced images with a higher image quality.

Although FIG. 10 shows the configuration in which the drive circuit 102, the interrupt switch 201, and the OLED 101 are arranged in this order on the current supply line 110 in the current flowing direction for each of the light-emitting units 200, the arrangement order of these elements is not limited to this. Alternatively, the arrangement order of the interrupt switch 201 and the OLED 101 may for example be reversed. Further alternatively, the OLED 101, the interrupt switch 201, and the drive circuit 102 may for example be arranged in this order.

Embodiment 3

In the above Embodiments 1 and 2, the configuration example is described in which the two power sources P and S are provided. In the present Embodiment 3 compared with this, a configuration is adopted in which the power source P doubles as the power source S without providing the power source S. Embodiment 3 differs from Embodiments 1 and 2 in this point.

Figure 14:
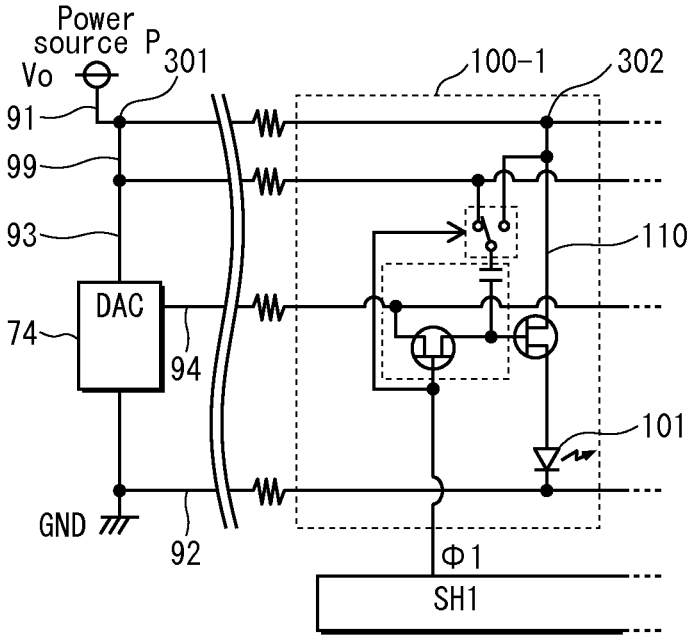
FIG. 14 shows only part of a circuit configuration relating to Embodiment 3.

FIG. 14 shows a circuit configuration relating to Embodiment 3, where only the light-emitting unit 100-1 is shown which is the closest to the power source P among the n light-emitting units 100, and a remainder of the n light-emitting units 100 is omitted.

As shown in the figure, although the power line 91 extends directly from the power source P like in Embodiment 1, the power line 99 extends at a position 301 on the power line 91 that is adjacent to the power source P.

A potential drop hardly occurs on the power line 99 and the power line 93 as described above. Accordingly, as long as the position 301, which is a connection point on the power line 91 with the power line 99, has substantially the same voltage as the voltage Vo of the power source P, this is substantially regarded as that the power line 99 is connected with the power source S in Embodiment 1.

Since a potential drop occurs on the power line 91 due to a current flowing through the respective OLEDs 101 included in the light-emitting units 100, it is desirable that the position (connection point) 301 should be a position on the power line 91 as close to the power source P, which is the power supply point, as possible, in other words, a position on the power line 91 whose wiring distance from a connection point with the power source P is as short as possible.

Specifically, the connection point 301 can be set at any position on a wiring part of the power line 91 between the power source P and a branch position 302 that is the closest to the power source P from which the current supply line 110 branches (a connection point of the light-emitting unit 100-1, which is provided the closest to the power source P, with the current supply line 110). The connection point 301 should be positioned at a position on the wiring part that is as close to the power source P as possible.

For this reason, circuit design can be performed such that the power source P, the connection point 301, and the DACs 74 are provided so as to be as close to one another as possible.

Alternatively, both the power line 91 and the power line 99 for example may each extend directly from the single power source P. Further alternatively, in the case where the degree of a potential drop on the power line 91 is determined beforehand to some extent and a potential at a position on the power line 91 that is distant from the power source P by a certain wiring distance is appropriate as a voltage to be supplied to the power line 99, this position on the power line 91 may be set as the connection point 301 with the power line 99 in spite of the certain wiring distance from the power source P.

In this way, since the configuration is adopted in which a voltage of the single power source P as a common power source is supplied to both the power line 91 and the power line 99, it is possible to simplify the circuits compared with the configuration in which the two power sources are separately provided, thereby reducing the manufacturing cost.

Although the above description has been given of the example where the configuration of the present Embodiment 3 in which the common power source is used is adopted to the circuit configuration of Embodiment 1, the configuration of the present Embodiment 3 may be adopted to the circuit configuration of Embodiment 2.

The present invention is not limited to an optical PH and an image forming apparatus, and alternatively may be a current control method for use in an optical PH that writes an optical beam onto an image carrier such as a photoreceptor.

Also, the present invention may be a program that enables a computer to execute the method. A computer program relating to the present invention may be recorded in computer-readable recording media, including for example a magnetic tape, a magnetic disk such as a flexible disk, and an optical recording medium such as DVD-ROM, DVD-RAM, CD-ROM, CD-R, MO, and PD. The computer program may be produced and transferred in the form of such a recording medium, or may be transmitted and provided via various kinds of wired or wireless networks such as the Internet, broadcasting, an electrical communication, a satellite communication, or the like.

The current control method may be for example a current control method for execution in an optical print head that includes a plurality of light-emitting elements that are connected to a plurality of current supply lines in one-to-one correspondence, the current supply lines branching from a first power line at different branch positions in a longitudinal direction thereof, the current control method comprising: a first step of writing a luminance signal into each of a plurality of holding elements that are provided in one-to-one correspondence with the light-emitting elements, the luminance signal being represented by a voltage indicating a light emission amount of a corresponding one of the light-emitting elements; and a second step of controlling, by each of a plurality of driving drivers that are provided in one-to-one correspondence with the current supply lines, a current supplied to a corresponding one of the current supply lines from the first power line, in accordance with a voltage that is held in a corresponding one of the holding elements when the luminance signal has been written into the corresponding one of the holding elements, wherein when the luminance signal is written into each of the holding elements in the first step, a second power line that is different from the first power line supplies a reference voltage to the holding element, the reference voltage being a reference when writing the luminance signal into the holding element.

(Modifications)

Although the present invention has been described based on the above embodiment, the present invention is not of course limited to the above embodiments. The present invention may include the following modifications.

(1) In the above embodiments, the configuration example has been described in which the drive circuits 102 are each a P-FET. However, the present invention is not limited to this. Alternatively, the drive circuits 102 each may be for example an N-FET (hereinafter, referred to as a drive circuit 102N).

In this configuration, it is possible to adopt a circuit configuration in which the OLED 101 and the drive circuit 102N are provided in this order for each of the light-emitting units 100 from the upstream to the downstream in the direction in which a current supplied from the power line 91 flows through the current supply line 110, the output terminal 123 (corresponding to the source) of the drive circuit 102N is connected with the cathode electrode line 92, and is also connected with the contact 142 of the power selector switch 104.

Even with this circuit configuration, it is possible to suppress unevenness in light emission amount between the OLEDs 101. Specifically, when a current from the power line 91 flows through the earth (GND) via the OLED 101, the drive circuit 102N, and the cathode electrode line 92, the wiring distance on the cathode electrode line 92 from the earth (GND) differs between the light-emitting units 100.

Accordingly, in the case where a circuit configuration is adopted in which, without providing the power selector switch 104, the one terminal 161 of the holding element 106 is connected with the gate 121 of the drive circuit 102N and the other terminal 162 of the holding element 106 is connected with the output terminal 123 of the drive circuit 102N, the following case might occur. That is, an influence of a potential drop due to the wiring resistance of the cathode electrode line 92 might cause a difference between the light-emitting units 100 in voltage of the output terminal 123 of the drive circuit 102N (corresponding to the reference voltage for obtaining the difference from the voltage representing the luminance signal SG), in accordance with the wiring distance from the earth (GND).

By adopting the circuit configuration in which the power selector switch 104 is provided, it is possible to use a voltage supplied from the power line 99 as the reference voltage for writing the luminance signal SG like in the above embodiments. This allows writing of the luminance signal SG with no influence of a potential drop due to a current flowing through the cathode electrode line 92.

(2) In the above embodiments, the OLEDs 101, the drive circuits 102, the power selector switches 104, and the switches 105, which are each a TFT, and so on are formed on the same the TFT substrate 71. Alternatively, other circuit configuration may be adopted.

Also, the description has been given of the configuration example in which the source IC 73, which includes one or more DACs 74, functions as the signal output subunit that outputs the luminance signal SG (the signal indicating the light emission amount) to each of the OLEDs 101 in order from a corresponding one of the DACs 74. However, the present invention is not limited to this, and alternatively other circuit configuration may be adopted.

Furthermore, the description has been given of the configuration example in which in the case where a voltage is supplied from the two power sources P and S as a constant voltage source, the power source S, which is different from the power source P, is used as a common power source with the DACs 74 (the signal output subunit) and the power line 99 for supplying the reference voltage for writing the luminance signal SG into each of the holding element 106. However, the present invention is not limited to this, and alternatively the circuit configuration may be adopted in which the power source of the DACs 74 is different from the power source of the power line 99.

The power line 99 may be wired such that no potential drop occurs on the power line 99 in the longitudinal direction thereof, or such that a potential drop occurs only to an extent that the unevenness in light emission amount does not deteriorate the image quality.

(3) In the above embodiments, the S/H circuits 103 (the signal writing unit), which each write the luminance signal SG indicating the voltage Vdac indicating the light emission amount into the holding element 106, injects, into a capacitor which is used as the holding element 106, a charge having an amount corresponding to the voltage Vf that is the difference between the voltage Vdac and the voltage Vs supplied from the power line 99 as an index value of the voltage Vf, and holds the injected charge in the capacitor. However, the present invention is not limited to this. Alternatively, any circuit may be employed as the S/H circuits 103 as long as the voltage Vf is rewritable into the holding element 106.

Also, in the above embodiments, the description has been given of the example in which the light-emitting elements are the OLEDs 101 which are current-driven light-emitting elements whose light emission amount varies in accordance with an amount of a current flowing therethrough (a magnitude of the flowing current). However, the present invention is not limited to this, and alternatively other types of elements such as LEDs may be employed as the light-emitting elements. Furthermore, the description has been given of the configuration example in which the drive circuits 102 as an example of the driving drivers are each an FET. Alternatively, other circuit may be employed. Moreover, the circuit configuration, the circuit elements, the voltage magnitude relation, and so on are not limited to the above.

Furthermore, the light-emitting units 100 may be each a switchable circuit in which the power selector switch 104 performs switch such that, a voltage is supplied from the power line 99 that is not influenced by a potential drop on the power line 91 in the sample periods as a reference voltage, which is applied to the other terminal 162 of the holding element 106 which is opposite to the one terminal 161 to which the voltage representing the luminance signal SG is input (as a reference voltage for storing a charge), and a voltage is supplied from the power line 91 instead of the power line 99 in the hold periods to the terminal 162.

Furthermore, although the power sources P and S each may be provided for example on the TFT substrate 71, at a position other than the TFT substrate 71 such as in the control unit 50, or the like, it is desirable that the power sources P and S each should be provided as close to the arrangement positions of the light-emitting units 100 as possible.

(4) In the above embodiments, the description has been given of the configuration example in which an optical PH is used as the printer 1. However, the present invention is not limited to this. Alternatively, the optical PH of the present invention may be applied as an optical PH for use in image forming apparatuses such as copiers and multiple function peripherals (MFPs) including a photoreceptor such as the photosensitive drum 11 into which images such as electrostatic latent images are written by an optical beam, and the like. Furthermore, it is possible to apply the optical PH of present invention to general devices that perform writing onto a photoreceptor by an optical beam, without limiting to image forming apparatuses.

Moreover, the above embodiments and modifications may be combined with each other as much as possible.

SUMMARY

The above embodiments and modifications each show one aspect for solving the problem described in the section RELATED ART, and are summarized as follows.

Specifically, one aspect of the present invention provides an optical print head including: a plurality of light-emitting elements that are connected to a plurality of current supply lines in one-to-one correspondence, the current supply lines branching from a first power line at different branch positions in a longitudinal direction thereof; a plurality of holding elements that are provided in one-to-one correspondence with the light-emitting elements; a signal writing unit that writes a luminance signal into each of the holding elements, the luminance signal being represented by a voltage indicating a light emission amount of a corresponding one of the light-emitting elements; a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line is common with a power source that supplies a voltage to the signal output subunit.

Also, the second power line may extend from the common power source that is different from a power source that supplies a current to the first power line.

Also, the second power line may extend from any position on the first power line between a power source that supplies a current to the first power line and one of the branch positions that is the closest to the power source, or may extend directly from the power source.

Also, the optical print head may further include a plurality of switch circuits that are provided in one-to-one correspondence with the holding elements, wherein the driving drivers are each a field effect transistor, the holding elements are each a capacitor with one terminal connected with a gate of a corresponding one of the field effect transistors, the switch circuits each switch between a first circuit and a second circuit, the first circuit having a configuration in which the reference voltage from the second power line is supplied to the other terminal of the capacitor, the second circuit having a configuration in which a voltage from the first power line is supplied to the other terminal of the capacitor, when writing the luminance signal, the signal writing unit inputs the luminance signal to the one terminal of the capacitor, and instructs the switch circuit to switch to the first circuit, and when having written the luminance signal, the signal writing unit interrupts inputting the luminance signal to the one terminal of the capacitor, and instructs the switch circuit to switch to the second circuit.

Also, the optical print head may further include a plurality of interrupt switches that are provided in one-to-one correspondence with the current supply lines, wherein when the signal writing unit writes the luminance signal, the interrupt switches are each open, and when the signal writing unit has written the luminance signal, the interrupt switches are each closed.

Also, the interrupt switches may be each provided between a corresponding one of the light-emitting elements and a corresponding one of the driving drivers.

Also, the driving drivers and the switch circuits may be each a thin-film transistor.

Also, the signal writing unit successively writes the luminance signal into each of the holding elements in accordance with a different timing.

Also, the light-emitting elements may be each an organic LED.

Also, the first power line and the second power line may be wired on the same substrate.

Also, the voltage that is held in the corresponding one of the holding elements when the signal writing unit has written the luminance signal into the corresponding one of the holding elements may correspond to a difference between the voltage representing the luminance signal and the reference voltage.

Another aspect of the present invention provides an image forming apparatus, including: a photoreceptor; and an optical writing unit that writes an image onto the photoreceptor by optical beam, wherein the optical writing unit includes: a plurality of light-emitting elements that are connected to a plurality of current supply lines in one-to-one correspondence, the current supply lines branching from a first power line at different branch positions in a longitudinal direction thereof; a plurality of holding elements that are provided in one-to-one correspondence with the light-emitting elements; a signal writing unit that writes a luminance signal into each of the holding elements, the luminance signal being represented by a voltage indicating a light emission amount of a corresponding one of the light-emitting elements; a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line is common with a power source that supplies a voltage to the signal output subunit.

With the above configuration, it is possible to use the voltage from the second power line that is different from the first power line, as the reference voltage for writing the signal which is represented by the voltage indicating the light emission amount of each of the light-emitting elements into a corresponding one of the holding elements.

Accordingly, it is possible to write the luminance signal into each of the holding elements with no influence of a potential drop on the first power line caused by a current flowing through a corresponding one of the light-emitting elements from the first power line, thereby further suppressing unevenness in light emission amount due to the potential drop on the first power line.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An optical print head comprising:

a plurality of light-emitting elements that are connected to a plurality of current supply lines in one-to-one correspondence, the current supply lines branching from a first power line at different branch positions in a longitudinal direction thereof;

a plurality of holding elements that are provided in one-to-one correspondence with the light-emitting elements;

a signal writing unit that writes a luminance signal into each of the holding elements, the luminance signal being represented by a voltage indicating a light emission amount of a corresponding one of the light-emitting elements;

a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line is common with a power source that supplies a voltage to the signal output subunit.

2. The optical print head of claim 1, wherein the second power line extends from the common power source that is different from a power source that supplies a current to the first power line.

3. The optical print head of claim 1, wherein the second power line extends from any position on the first power line between a power source that supplies a current to the first power line and one of the branch positions that is the closest to the power source, or extends directly from the power source.

4. The optical print head of claim 1, further comprising a plurality of switch circuits that are provided in one-to-one correspondence with the holding elements, wherein the driving drivers are each a field effect transistor, the holding elements are each a capacitor with one terminal connected with a gate of a corresponding one of the field effect transistors, the switch circuits each switch between a first circuit and a second circuit, the first circuit having a configuration in which the reference voltage from the second power line is supplied to the other terminal of the capacitor, the second circuit having a configuration in which a voltage from the first power line is supplied to the other terminal of the capacitor, when writing the luminance signal, the signal writing unit inputs the luminance signal to the one terminal of the capacitor, and instructs the switch circuit to switch to the first circuit, and when having written the luminance signal, the signal writing unit interrupts inputting the luminance signal to the one terminal of the capacitor, and instructs the switch circuit to switch to the second circuit.

5. The optical print head of claim 4, further comprising a plurality of interrupt switches that are provided in one-to-one correspondence with the current supply lines, wherein when the signal writing unit writes the luminance signal, the interrupt switches are each open, and when the signal writing unit has written the luminance signal, the interrupt switches are each closed.

6. The optical print head of claim 5, wherein the interrupt switches are each provided between a corresponding one of the light-emitting elements and a corresponding one of the driving drivers.

7. The optical print head of claim 4, wherein the driving drivers and the switch circuits are each a thin-film transistor.

8. The optical print head of claim 1, wherein the signal writing unit successively writes the luminance signal into each of the holding elements in accordance with a different timing.

9. The optical print head of claim 1, wherein the light-emitting elements are each an organic LED.

10. The optical print head of claim 1, wherein the first power line and the second power line are wired on the same substrate.

11. The optical print head of claim 1, wherein the voltage that is held in the corresponding one of the holding elements when the signal writing unit has written the luminance signal into the corresponding one of the holding elements corresponds to a difference between the voltage representing the luminance signal and the reference voltage.

12. An image forming apparatus, comprising:

a photoreceptor; and an optical writing unit that writes an image onto the photoreceptor by optical beam, wherein the optical writing unit includes:

a plurality of light-emitting elements that are connected to a plurality of current supply lines in one-to-one correspondence, the current supply lines branching from a first power line at different branch positions in a longitudinal direction thereof;

a plurality of holding elements that are provided in one-to-one correspondence with the light-emitting elements;

a signal writing unit that writes a luminance signal into each of the holding elements, the luminance signal being represented by a voltage indicating a light emission amount of a corresponding one of the light-emitting elements;

a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line is common with a power source that supplies a voltage to the signal output subunit.

13. An optical print head comprising:

a plurality of light-emitting elements that are connected to a plurality of current supply lines in one-to-one correspondence, the current supply lines branching from a first power line at different branch positions in a longitudinal direction thereof;

a plurality of holding elements that are provided in one-to-one correspondence with the light-emitting elements;

a signal writing unit that writes a luminance signal into each of the holding elements, the luminance signal being represented by a voltage indicating a light emission amount of a corresponding one of the light-emitting elements;

a second power line that is different from the first power line, and supplies a reference voltage to each of the holding elements, the reference voltage being a reference when the signal writing unit writes the luminance signal into the holding element; and a plurality of driving drivers that are provided in one-to-one correspondence with the current supply lines, and each control a current supplied to a corresponding one of the current supply lines from the first power line, in accordance with a voltage that is held in a corresponding one of the holding elements when the signal writing unit has written the luminance signal into the corresponding one of the holding elements, wherein the signal writing unit includes a signal output subunit that outputs the luminance signal, and a power source that supplies the reference voltage to the second power line and supplies a voltage to the signal output subunit.

* * * * *